US005906058A

United States Patent [19]

Rench et al.

[11] Patent Number: 5,906,058

[45] **Date of Patent: *May 25, 1999**

[54] SNOWBOARD BOOT HAVING A RIGID STRUT

[75] Inventors: Chris J. Rench, Bend, Oreg.; John E. Svensson, Vashon, Wash.

[73] Assignee: K-2 Corporation, Vashon, Wash.

[ * ] Notice: This patent is subject to a terminal disclaimer.

[21] Appl. No.: 08/597,523

[22] Filed: Feb. 2, 1996

Related U.S. Application Data

[63] Continuation-in-part of application No. 08/274,292, Jul. 12, 1994, Pat. No. 5,505,477, which is a continuation-in-part of application No. 08/127,584, Sep. 27, 1993, Pat. No. 5,802,744, and a continuation-in-part of application No. 08/120,629, Sep. 13, 1993, Pat. No. 5,452,907, and a continuation-in-part of application No. 08/100,745, Aug. 2, 1993, abandoned, and a continuation-in-part of application No. 08/094,576, Jul. 19, 1993, Pat. No. 5,437,466.

[51] Int. Cl.[6] ..... A43B 5/04; A43B 5/16

[52] U.S. Cl. ..... 36/117.1; 36/115

[58] Field of Search ..... 36/115, 117.1, 36/118.2, 118.8, 118.9, 118.7, 117.2, 117.3

[56] References Cited

U.S. PATENT DOCUMENTS

| | | | |
|---|---|---|---|
| 3,593,356 | 7/1971 | Schmalfeldt | 9/310 E |
| 3,900,204 | 8/1975 | Weber | 280/11.13 S |
| 4,871,337 | 10/1989 | Harris | 441/74 |
| 4,882,857 | 11/1989 | Sartor et al. | 36/118.9 X |
| 4,944,100 | 7/1990 | Sartor et al. | 36/118.9 |
| 4,969,655 | 11/1990 | Katz | 280/14.2 |
| 4,973,073 | 11/1990 | Raines et al. | 280/624 |
| 5,018,468 | 5/1991 | Peterson | 114/39.2 |
| 5,031,341 | 7/1991 | Paris et al. | 36/118.8 |
| 5,035,443 | 7/1991 | Kincheloe | 280/618 |
| 5,145,202 | 9/1992 | Miller | 280/613 |
| 5,156,644 | 10/1992 | Koehler et al. | 280/14.2 |
| 5,197,209 | 3/1993 | Rolland et al. | 36/118.9 |
| 5,261,689 | 11/1993 | Carpenter et al. | 280/618 |
| 5,299,823 | 4/1994 | Glaser . | |
| 5,401,041 | 3/1995 | Jespersen | 280/14.2 |
| 5,409,244 | 4/1995 | Young | 280/14.2 |
| 5,435,080 | 7/1995 | Meiselman | 36/117.1 |
| 5,520,406 | 5/1996 | Anderson et al. | 280/624 |
| 5,647,148 | 7/1997 | Meiselman | 36/115 |
| 5,664,344 | 9/1997 | Marmonier | 36/118.9 X |

FOREIGN PATENT DOCUMENTS

| | | | |
|---|---|---|---|
| 430821 | 6/1991 | European Pat. Off. | 36/117.1 |
| 0 646 334 A1 | 4/1995 | European Pat. Off. . | |
| 2629691 | 10/1989 | France | 36/118.8 |
| 2653310 | 4/1991 | France | 36/118.9 |
| 3825681 A1 | 2/1990 | Germany . | |
| 4219036A1 | 1/1993 | Germany . | |
| 9216120 | 10/1992 | WIPO | 36/118.8 |
| WO 94/26365 | 11/1994 | WIPO . | |
| WO 96/01575 | 1/1996 | WIPO . | |

*Primary Examiner*—B. Dayoan

*Attorney, Agent, or Firm*—Christensen O'Connor Johnson & Kinness PLLC

[57] ABSTRACT

A boot and binding allows step-in attachment to a snowboard while supporting the ankle of the user and allowing desired flexibility. The sole includes binding-receiving elements for attaching the boot to the binding on the snowboard. The sole also has toe and heel ends. The sole is formed with a heel counter at the heel end. Tread projects from the sole for traction when the boot is not attached to the snowboard. The strut extends upwardly from the heel counter of the base. The strut extends upwardly from the heel counter of the base. The strut provides aft support to the wearer. The upper is fixedly attached to the sole and is arranged and configured to receive the foot and ankle of the user. The upper has a rearward side adjacent the strut. The upper is more flexible than the strut and the highback. The binding disclosed includes a plate for attachment to the snowboard, a first coupling member to secure the forward end of the boot, and a second coupling member to secure the rearward end of the boot. The coupling members are releasably secured to the boot with at least one arm that extends from the side of the plate. The coupling member that secures the forward end of the boot may include either a set of jaws, a simple hook, or ridges on the sides of the toe portion.

23 Claims, 29 Drawing Sheets

120
362
22
300
302
158
306
304
318
308
320
316
312

120
362
22
300
158
302
306
304
304
318
308
320
316
312

SNOWBOARD BOOT HAVING A RIGID STRUT

This application is a continuation-in-part of U.S. patent application Ser. No. 08/274,292, filed Jul. 12, 1994, now U.S. Pat. No. 5,505,477, which is a continuation-in-part of U.S. patent applications Ser. Nos. 08/127,584, filed Sep. 27, 1993, now U.S. Pat. No. 5,802,744; 08/120,629, filed Sep. 13, 1993, now U.S. Pat. No. 5,452,907; 08/100,745, filed Aug. 2, 1993, now abandoned; and 08/094,576, filed Jul. 19, 1993, now U.S. Pat. No. 5,437,466.

FIELD OF THE INVENTION

The present invention relates generally to boots and bindings for sports equipment and, more particularly, to sport boots and bindings for releasable attachment to snow boards and the like.

BACKGROUND OF THE INVENTION

Snowboards have been in use for a number of years, and snowboarding has become a popular winter sports activity. A snowboard is controlled by weight transfer and foot movement, both lateral and longitudinal. Precision edge control is especially important in alpine snowboarding activities where carving, rather than sliding, through the snow is desirable. Therefore, small movements of the snowboarder's feet within the boots can have significant effects on the user's control over the snowboard's movement. However, boot flexibility is also important for many recreational and freestyle snowboarding activities. Despite the widespread acknowledgment of the importance of these two desirable factors of edge control and flexibility, snowboard boots generally do not satisfactorily provide both.

To provide control, mountaineering-type boots have been used, especially in Europe. These boots include a molded plastic, stiff outer shell and a soft inner liner. The boots are mounted on the snowboard using mountaineering or plate bindings. Plate bindings are fastened to the board under the fore and aft portions of the sole of the boot and typically provide both heel and toe bails to secure the boot in place, usually without any safety release mechanism. These boots are stiff enough to provide the desired edge control and stability for carving. However, they are too stiff to allow significant lateral flexibility, a key movement in the sport that is essential for freestyle enthusiasts and desirable for all-around snowboarders. As a result, the mountaineering-type boots feel too constraining to many snowboarders.

Freestyle snowboarding requires more flexibility of the ankle of the snowboarder relative to the board than the mountaineering-type boots allow. Even all-around recreational snowboarding requires some boot flexibility. The stiff mountaineering-type boots offer little lateral flexibility and only marginal fore and aft flexibility. Because of the desire for flexibility, most American snowboarders have opted for an insulated snow boot combined with "soft-shell" bindings. These bindings have rigid bases attached to the board, highback shells, straps to wrap around the boot, and buckles to secure the straps in place. The boots, when removed from the bindings, are standard insulated snow boots or slightly modified snow boots. The flexibility gained from the soft boot and relatively soft binding results in less edge control than a mountaineering-type boot and difficult entry and release. The snowboarder may attempt to gain more edge control by tightening his binding straps around his boots. However, such overtightening may seriously sacrifice comfort. A related problem occurs every time the snowboarder reaches flat terrain, the bottom of the hill, or the chairlift. The snowboarder must unbuckle the straps of at least one binding to scoot along skateboard-style by pushing with the released foot. This may be time consuming and cumbersome, since proper securing and tightening of the binding is difficult. Disembarking from the chairlift with only one boot nonreleasably attached to the snowboard is also hazardous, since the leverage of the board on one ankle or knee could easily cause injury in a fall.

Manufacturers' attempts at providing both edge control and flexibility have centered around plate bindings for use with stiff mountaineering-type boots. Plate bindings offer ease of entry and release no buckles to unsnap or straps to tighten. They may also be made releasable in response to forces placed thereon during use. Plate binding manufacturers have approached the problem of lateral flexibility from several different angles. For example, one type of binding, made by Emery, offers a two-piece plate-one for the heel and the other for the toe. Under each toeplate and heelplate is a half-inch high rubber pad shaped in the form of a rectangle. The rubber ad is supposed to act as a shock absorber and provide side-to-side flex.

Other attempts have used adaptations of Swiss mountaineering bindings. A hard plate is mounted to the board. Two rectangular boxes—at the toe and heel—cradle a spring steel cage. Bails are connected to the cage and act as cantilevers in creating a side-to-side flex. However, such attempts may sacrifice some edge control by making the interface between boot and board too soft in order to achieve the desired lateral flexibility.

In general, the public has not been satisfied with the use of binding plates to solve the flexibility/control dichotomy and the ease of entry and exit problem. Those serious snowboarders who desire to both carve racing turns and "board" freestyle, purchase two boards and two sets of bindings and boots. Those who are simply recreational boarders or cannot afford the two-board luxury, generally settle on one type or the other, and thus sacrifice performance and/or convenience of one type or the other.

The boot and binding of the present invention solves the flexibility/control problem by proceeding in a different direction from past attempts. The invention provides a boot that allows most of the flexibility of the soft shell boot/binding while retaining the advantages of control and ease of entry and release of the mountaineering-type boot/binding arrangement. The invention thus allows greater comfort, convenience, all-around performance, and safety.

SUMMARY OF THE INVENTION

The present invention provides snowboard boots and bindings. The boots are flexible while giving proper support for edge control of the snowboard. The boots are also much easier to use than a typical freestyle boot, as the soft shell binding is not needed, and a step-in binding can be used.

The snowboard boot of the present invention has medial, lateral, forward, and rearward sides. The boot is adapted for extending around the foot and lower portion of a wearer. The boot includes a sole, an upper, and a rigid strut. The sole has a heel portion and a toe portion. The upper is attached to the sole and is flexible in fore, aft, lateral, and medial directions. The upper extends upwardly from the sole and includes a leg portion to surround a portion of the leg of the wearer. The rigid strut is also attached to the sole. The strut extends adjacent the rearward side of the upper. The strut restrains substantial aft movement of the leg portion of the upper while not substantially restricting fore and medial movement.

In the preferred embodiment, the leg portion of the upper is movable relative to the strut. The sole of the boot includes a rigid heel counter affixed thereto. The strut is secured to the heel counter. Preferably, the strut is pivotally secured to the heel counter for pivotal movement of the strut about a substantially vertical axis. The lateral and medial sides of the strut are secured within lateral and medial slots, respectively, in the heel counter.

Another aspect of the preferred embodiment includes a strut release to substantially remove the aft restraint of the strut from the leg portion of the boot upper. Both the lateral and medial sides of the strut are secured to the heel counter slots with quick release fasteners. The strut also includes an adjustment member for changing the position of the strut relative to the sole. Adjustment of the strut changes the angle at which the strut leans in the fore and aft directions.

In another aspect of the invention, the strut includes an upper portion and two side portions. A medial side portion is attached to the medial side of the heel counter and a lateral side portion is attached to the lateral side. The upper portion is pivotally and slidably connected to the side portions of the strut. This arrangement allows for rearward pivotal movement of the upper portion with respect to the side portions to remove aft support from the leg portion of the upper.

Preferably, the strut is asymmetric. The upper portion and lateral side of the strut curve forwardly more than the upper portion of the medial side. The asymmetric nature of the strut allows more freedom of movement of the leg portion of the upper of the boot in the medial direction.

As another aspect of the preferred embodiment of the snowboard boot of the present invention, a step in binding interface is attached to the sole of the boot. The interface allows the boot to be secured to a step-in type snowboard binding on a snowboard. The binding interface includes a recess within the bottom of the heel portion of the sole. An attachment element is secured within the recess. The binding interface also includes ridges secured to the toe portion of the sole. Alternatively, the binding interface may include a rod secured to the heel portion of the sole.

The invention may also be defined as a combination of a boot and a binding for securing the boot to a snowboard. The boot has a toe end, a heel end, a lateral side, a medial side, and a longitudinal axis. The boot includes a sole, an upper, medial and lateral toe ridges, and a heel attachment structure. The sole has a toe portion and a heel portion. The upper is affixed to the sole and extends upwardly from the sole. The upper includes a leg portion adapted for surrounding a lower portion of a leg of the wear. The medial and lateral toe ridges are affixed to the medial and lateral sides of the toe portion of the sole. The ridges extend generally parallel to the longitudinal axis of the boot. The heel attachment structure is affixed to the heel portion of the sole.

The binding includes a rigid plate, medial and lateral binding ridges, and a heel attachment mechanism. The rigid plate has at least one aperture for attachment of the plate to the snowboard. The medial and lateral binding ridges project upwardly from the plate. The ridges are disposed above the medial and lateral toe ridges of the boot when the boot is engaged therewith. The heel attachment mechanism projects upwardly from the plate. The mechanism is releasably securable to the heel attachment structure of the boot.

The heel attachment structure of the boot includes an aperture within the bottom of the heel portion of the sole of the boot. The heel attachment mechanism of the binding includes an upward projection extending from the plate. The upward projection has at least one side projection engageable within the aperture of the heel attachment structure. The upward projection preferably is constructed of a post rotatably secured to the plate for rotation about a substantially vertical axis. The side projection includes a pin extending from opposite sides of the post near the top of the post. The heel attachment mechanism also includes a lever arm attached to the upper projection for moving it and the side projection into and out of engagement with the heel attachment structure of the boot.

The rigid plate is generally Y-shaped in the preferred embodiment. Arms form the top of the Y-shaped plate. The arms are medial and lateral arms having forward ends with binding ridges extending from the forward ends. At least one of the arms includes an adjustment mechanism to change the length of the arm to accommodate different boot sizes.

The toe ridges on the sides of the boot preferably form slots on the medial and lateral sides of the toe end of the boot. The rearward ends of the slots include stops for limiting rearward movement of the binding ridges and for aligning the boot over the binding.

Another aspect of the boot and binding combination includes a rearward support strut attached to the heel end of the boot. This strut limits rearward movement of the leg portion of the boot.

In another aspect of an alternate embodiment of the invention, the heel attachment structure includes a rod attached to the heel portion of the sole. The heel attachment mechanism of the binding includes a jaw attached to the binding plate for securing the rod.

The many aspects of the invention summarized above provide numerous advantages of the embodiments of the invention over the prior art snowboard boots and bindings available. The boot is comfortable and easy to walk in, like a conventional snowboard boot, while providing the ease and convenience of a step-in binding. Since the toe and heel of the boot are separately attached to the binding, the sole of the boot can be flexible. Also, with the integrated support strut on the back of the boot this can be eliminated from the binding. The disengageable feature of the support strut also aids in comfortable walking when the strut is not being used for support during riding. However, the strut is easily engaged and disengaged as desired. The adjustable nature of several aspects of the invention also adds to the versatility, ease of use, and performance of the boot and binding system. For example, the ability to adjust the forward lean of the support strut for different riding styles or conditions improves performance. The same is true with the ability to adjust the strut for increased or decreased lateral or medial support by rotating the strut about a vertical axis. The binding is quick with a step-in convenience much like a ski binding. The binding is also non-releasable with a positive latch mechanism. The snowboarder knows that the latch is engaged as the lever will not close until positive engagement is assured. The self-aligning nature of the boot and binding ridges interfacing with each other also adds to the ease in which the user may simply step into the binding.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
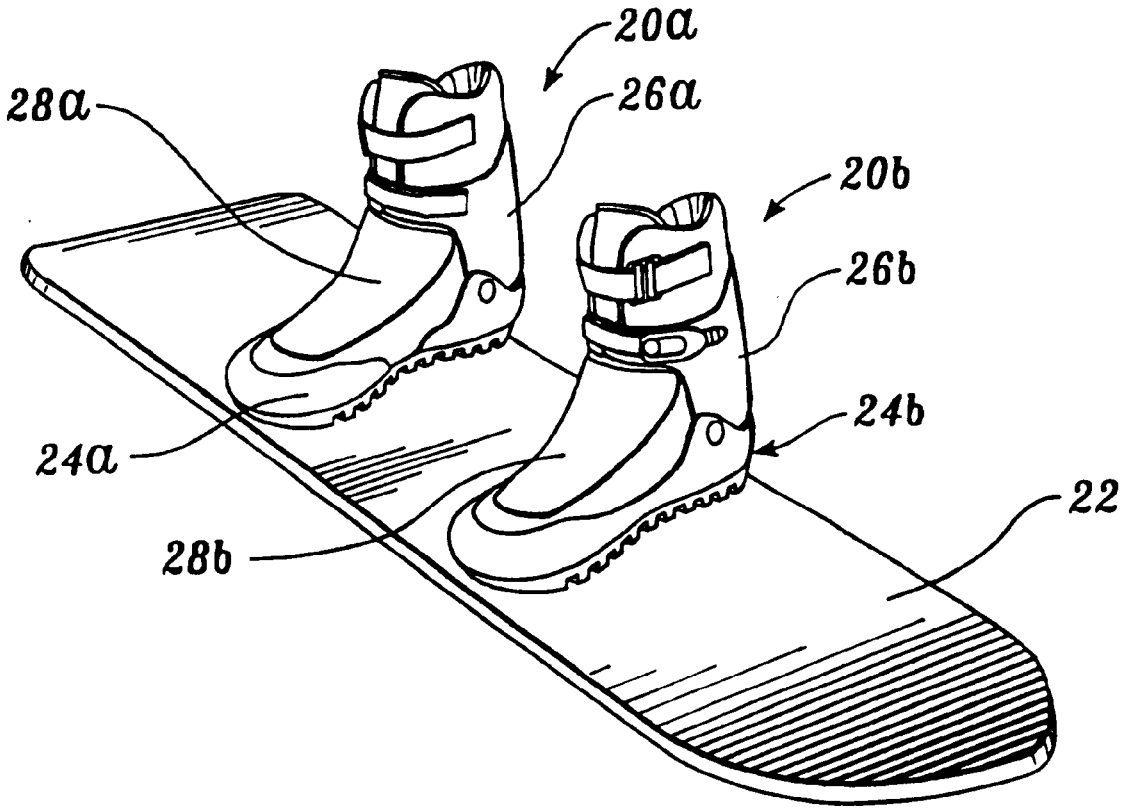
FIG. 1 is a perspective view of one embodiment of the snowboard boots showing the boots attached to a snowboard.

Referring to FIG. 1, boots 20 of the present invention are illustrated in a ready-to-ride position attached to a snowboard 22. Each of boots 20 includes a base 24, a highback 26, and an upper 28. The foot of the user is cupped by base 24. Highback 26 is pivotally connected to base 24 and extends behind and partially on the sides of upper 28. Upper 28 is fixedly secured to base 28. Thus, snowboard boots 20 are provided that combine a soft upper with the support of a soft shell binding built right into the boot itself. With this arrangement, the user can conveniently use standard step-in bindings or other specialized step-in bindings discussed below.

Figure 2:
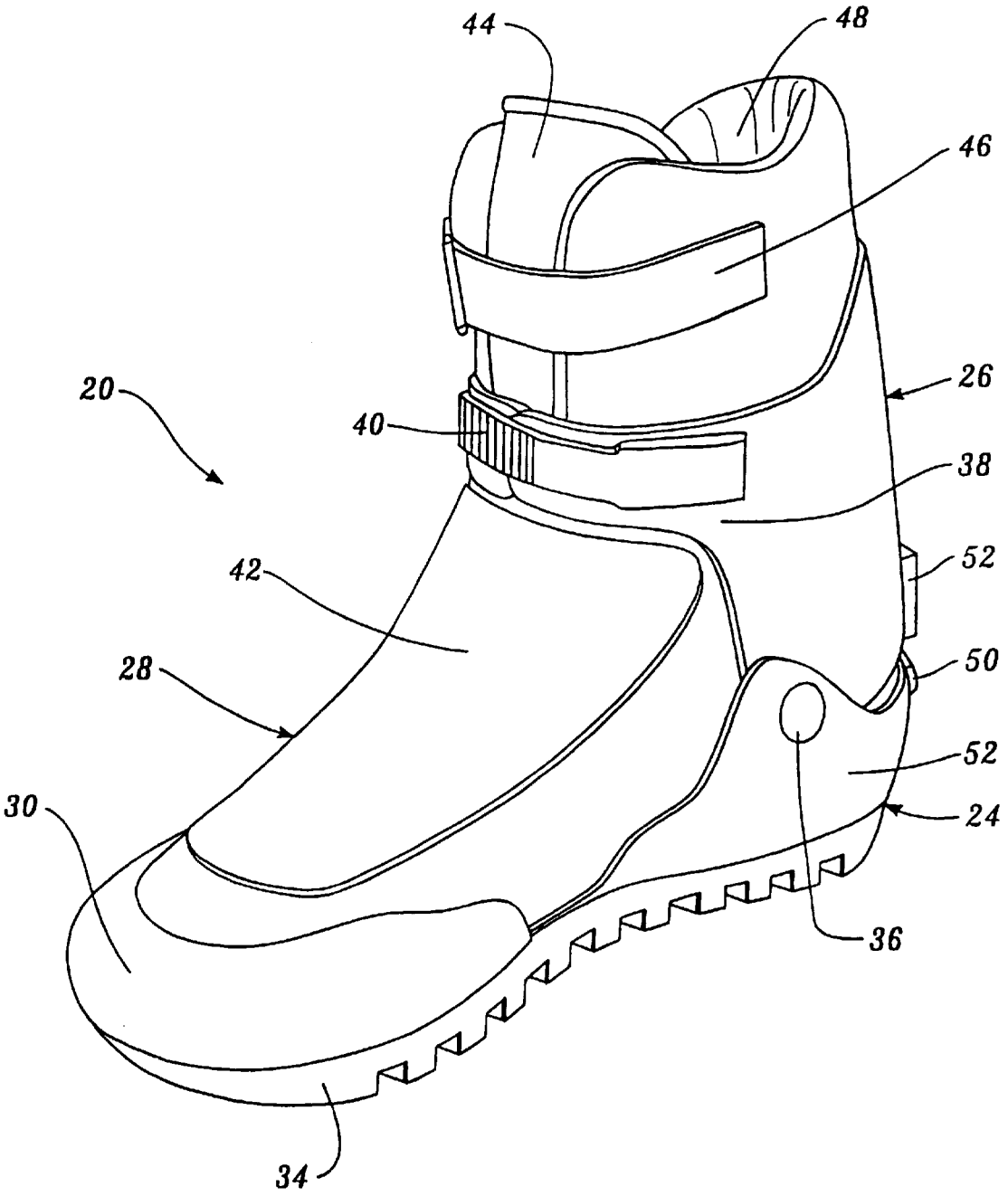
FIG. 2 is a perspective view of the right boot illustrated in FIG. 1.
Figure 3:
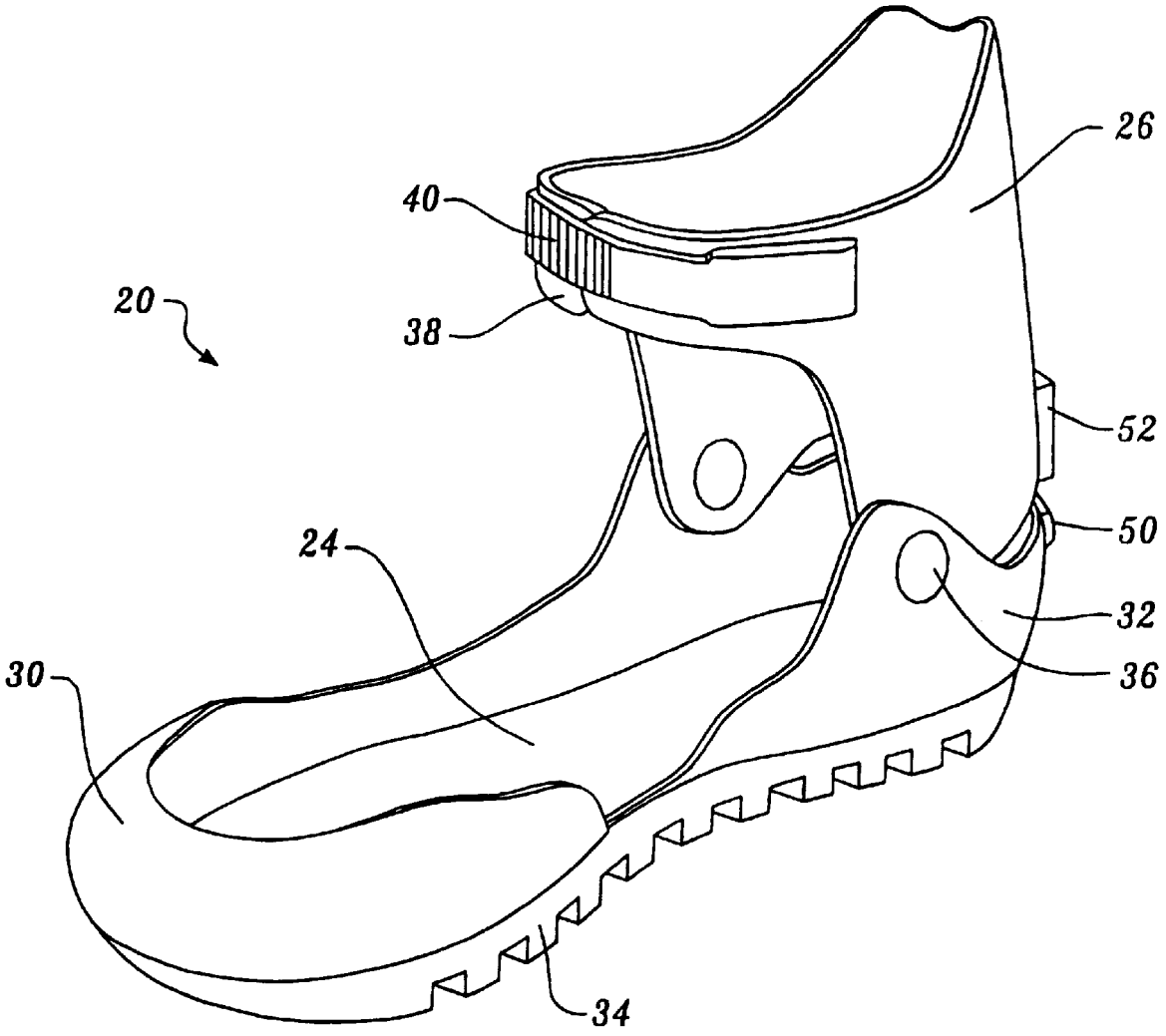
FIG. 3 is a perspective view of the base and the highback of the boot illustrated in FIG. 2.

Referring to FIGS. 2 and 3, the details of boot 20 will be discussed in more detail. Base 24 is preferably constructed of a semi-rigid material that allows some flex and is resilient. Base 24, for example, may have a base construction similar to the sole construction of either hiking or mountaineering boots. Base 24 includes a toecap 30, a heel counter 32, and tread 34. Toecap 30 is preferably an integrally formed portion of base 24. Toecap 30 surrounds the toe or forward end of upper 28. Alternatively, toecap 30 may not be used or may be formed of a different material from the rest of base 24, such as rubber. The function of toecap 30 is to protect the forward end of upper 28 from wear and water. In some boot-to-snowboard arrangements toecap 30 may slightly extend over the edge of snowboard 22. Thus, toecap 30 would function to protect not only upper 28, but also the foot of the user from injury. Toecap 30 also extends around the side of the ball of the foot of the user. This arrangement adds additional lateral and torsional support to the foot of the user.

Base 24 also includes a heel counter 32 extending upwardly from the heel or rearward end of base 24. Heel counter 32 surrounds and cups the heel portion of upper 28 and provides lateral support to the heel of the user. As with toecap 30, heel counter 32 is preferably formed as an integral part of base 24. Alternatively, however, heel counter 32 could be constructed of a different material and attached to base 24.

Tread 34 extends downwardly from base 24. Tread 34 is preferably formed of a different material than the remainder of base 24. The construction of tread 34 is preferably like that of conventional snow boots such as those sold under the Sorels name. Tread 34 may alternatively be constructed of a Vibram rubber, as commonly used on hiking boots; base 24 may also include a metal or plastic composite shank. The toe end of tread 34 angles upwardly toward toecap 30 so as not to interfere with edging of the snowboard if the toe end of boot 20 extends slightly over the edge of the snowboard. The heel end of tread 34 also angles upwardly toward heel counter 32 at an angle of about 45 degrees.

Highback 26 is pivotally connected to heel counter 32 by a highback pivot 36. This pivot is preferably a heavy-duty rivet, but may alternatively be any other type of conventional pivoting fastener connection. In the alternative embodiments, discussed below, highback pivot 36 may be shifted rearwardly or may not be used at all. Heel counter 32 includes an upward projection to allow highback pivot 36 to be placed just beneath the ankle bone of the user for proper pivotal movement of highback 26. Highback 26 is preferably formed of a resilient plastic material that is rigid enough to provide the desired ankle support to the user. Highback 26 extends upwardly from heel counter 32, adjacent the rear, and portions of the sides of upper 28. Highback 26 preferably provides greater aft support than lateral support, as will be explained below.

In the embodiment illustrated in FIG. 2, highback 26 includes a cuff 38 that extends completely around upper 28 above the ankle of the user. A highback strap 40 is attached to cuff 38 to fasten the opposing ends of cuff 38 together and help secure the foot of the user within upper 28.

Upper 28 is fixedly attached to base 24 by being secured beneath the last (not shown) of base 24. Toecap 30 and heel counter 32 may also be glued to upper 28. However, highback 26 is preferably not fixedly attached to upper 28, to allow for relative movement between the two. Upper 28 extends above highback 26. Upper 26 also includes laces (not shown) and lace cover 42 to protect the laces and the foot of the user from snow, ice, and entering moisture. Lace cover 42 is connected to upper 28 adjacent toecap 30 and is held in place over the laces by hook-and-loop fasteners (not shown) under its edges. Upper 28 is preferably constructed principally of leather, but may alternatively be formed from ballistic nylon or other flexible, natural or manmade material. A conventional tongue 44 is also provided within upper 28.

In the embodiment shown in FIG. 2, an upper strap 46 is fastened between the opposing sides of upper 28 above cuff 38. Upper strap 46 helps secure the top portion of upper 28 to the leg of the user. Upper strap 46 uses a hook-and-loop type fastener and folds back on itself after being threaded through a buckle (not shown). A liner 48, including padding, is sewn within upper 28 to receive, cushion, and insulate the foot of the user.

One other feature of boot 20 illustrated in FIGS. 2 and 3 is a bottom lip 50 and a stop block 52. Bottom lip 50 is formed integrally from the rearward edge of heel counter 32. Bottom lip 50 projects outwardly. Stop block 52 is fastened to the rearward side of highback 26 directly above bottom lip 50. As the lower edge of stop block 52 contacts the upper edge of bottom lip 50, pivotal rotation of highback 26 is stopped. The position of stop block 52 can be changed to vary the angle of highback 26 for greater or less forward lean. Stop block 52 and bottom lip 50 are seen in more detail in FIG. 9.

Figure 4A:
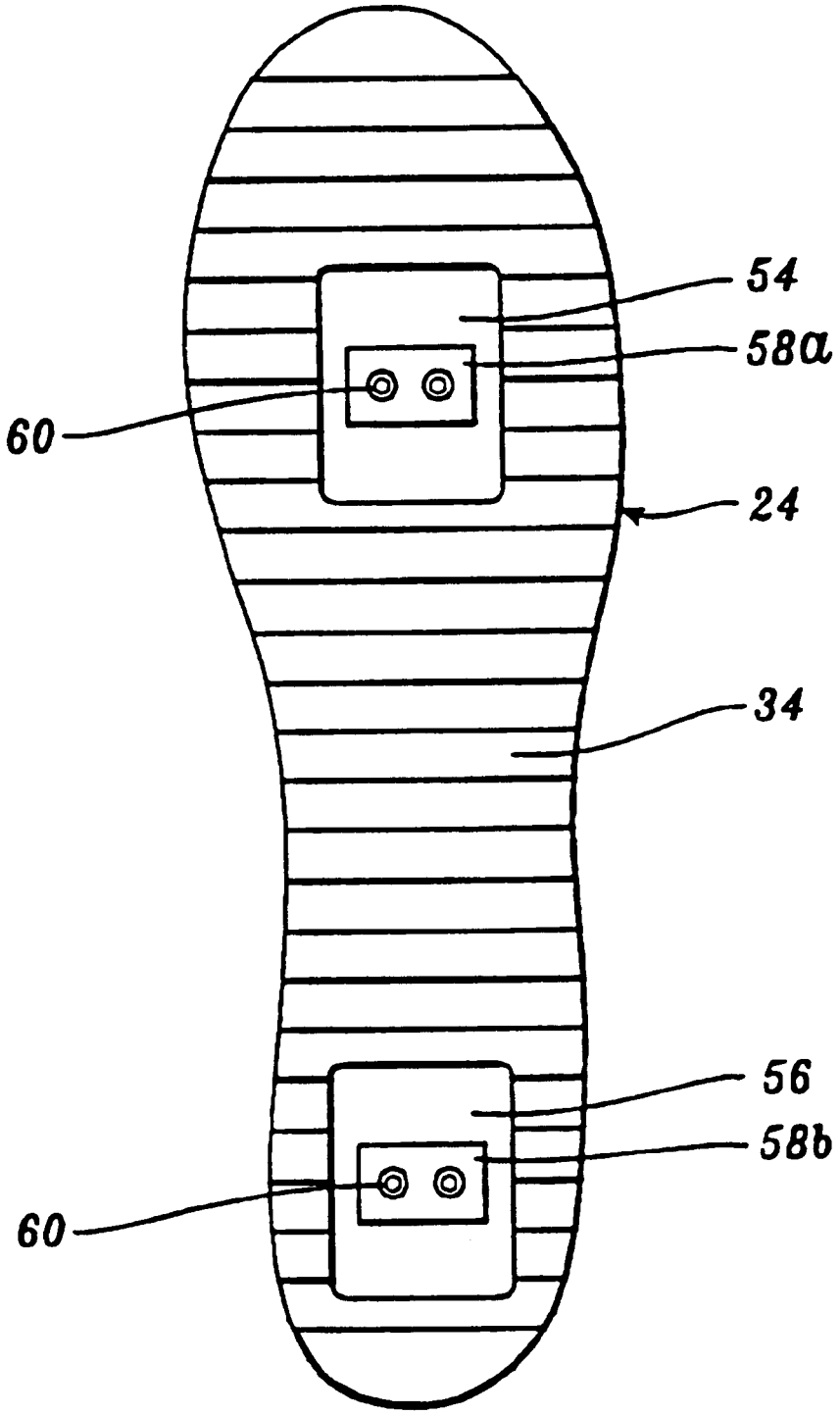
FIG. 4A is a bottom view of the boots illustrated in FIGS. 1 through 3, showing binding attachment plates within recesses.
Figure 4B:
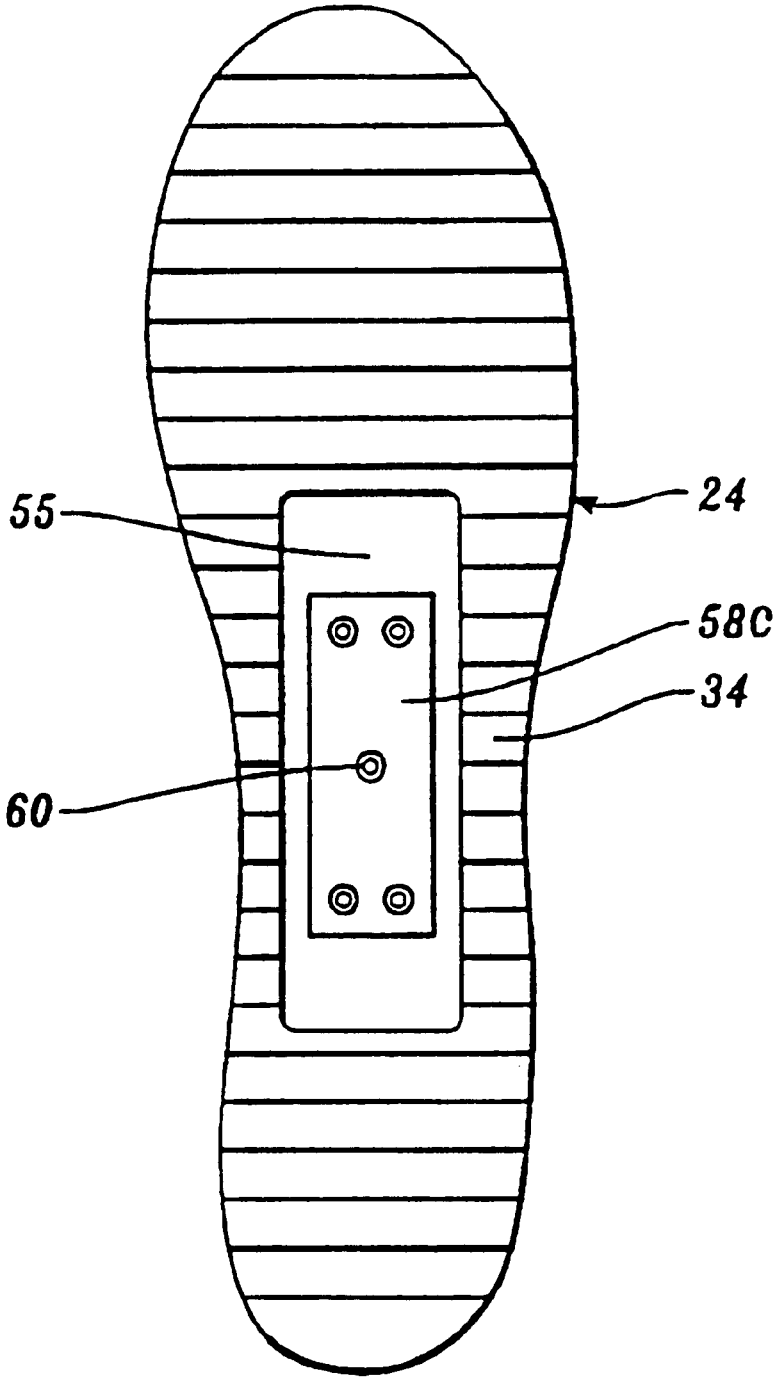
FIG. 4B is a bottom view of a second embodiment of the boot, showing one binding attachment plate within a recess.

Two different embodiments of the bottom of boot 20 are illustrated in FIGS. 4A and 4B. A basic tread pattern is shown in FIGS. 4A and 4B, although, alternatively, any tread pattern could be used. In the embodiment shown in FIG. 4A, base 24 includes a forward recess 54 and a rearward recess 56. Recesses 54 and 56 are surrounded by tread 34. Recesses 54 and 56 are preferably rectangular but could be any configuration needed to interface with step-in snowboard bindings. Forward and rearward boot plates 58 are mounted inside recesses 54 and 56. Boot plates 58 are secured by fasteners 60. Boot plates 58 are also rectangular, although somewhat smaller than recesses 54 and 56 so as to allow room for the jaws of snowboard bindings to grasp the edges of boot plates 58. Preferably, the minor axes of boot plates 58 are parallel to the longitudinal axis of base 24.

In the embodiment shown in FIG. 4B, base 24 includes a single recess 55 surrounded by tread 34. Recess 55 is preferably rectangular but, alternatively, could be any shape desired to interface with step-in snowboard bindings. Boot plate 58*c* is mounted inside recess 55 and secured by fasteners 60. Boot plate 58*c* is also preferably rectangular and is somewhat smaller than recess 55. The major axis of boot plate 58*c* is preferably parallel to the longitudinal axis of base 24.

Figure 5:
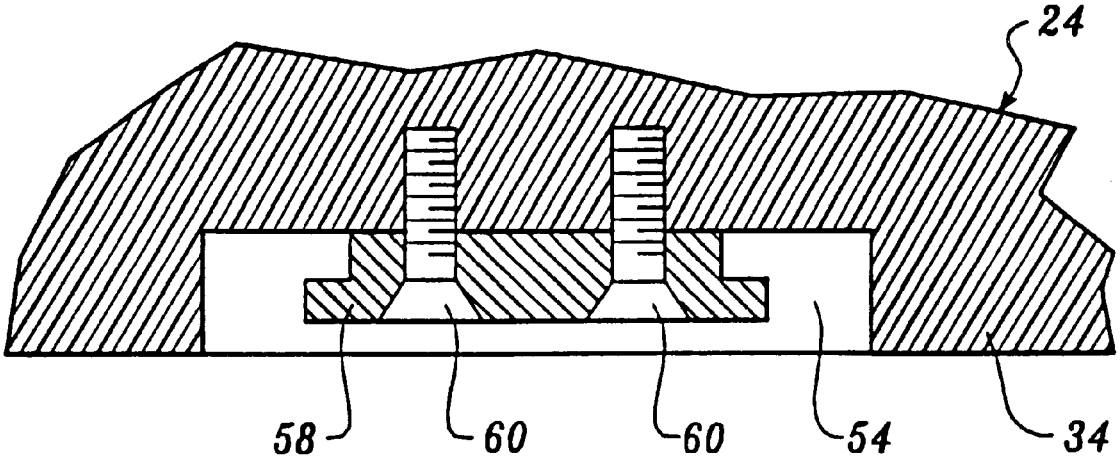
FIG. 5 is a cross-sectional view of the binding attachment plate secured to the base of the boot.

FIG. 5 illustrates a cross-sectional view of boot plate 58. In cross section, boot plate 58 has an upside-down T shape providing projecting edges onto which the jaws of the snowboard binding may grasp. FIG. 5 also shows how the bottom of tread 34 projects beneath the level of boot plate 58.

Figure 6A:
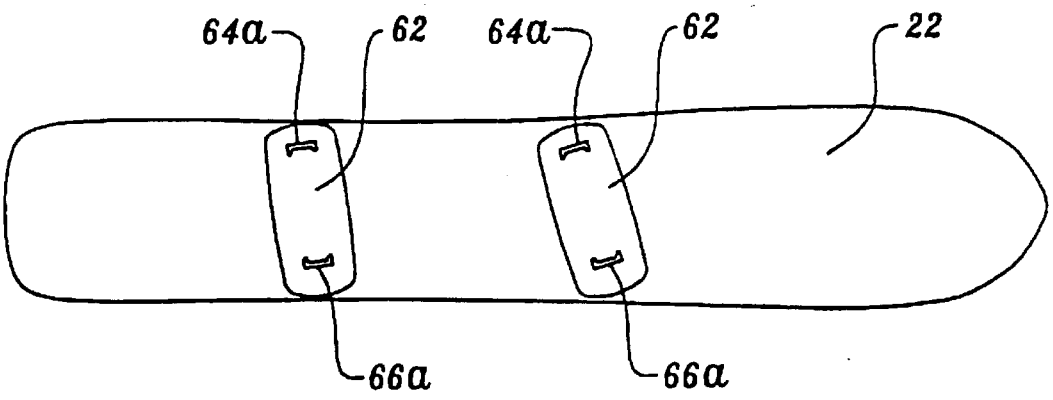
FIG. 6A is a top view of a snowboard illustrating one embodiment of the bindings.
Figure 6B:
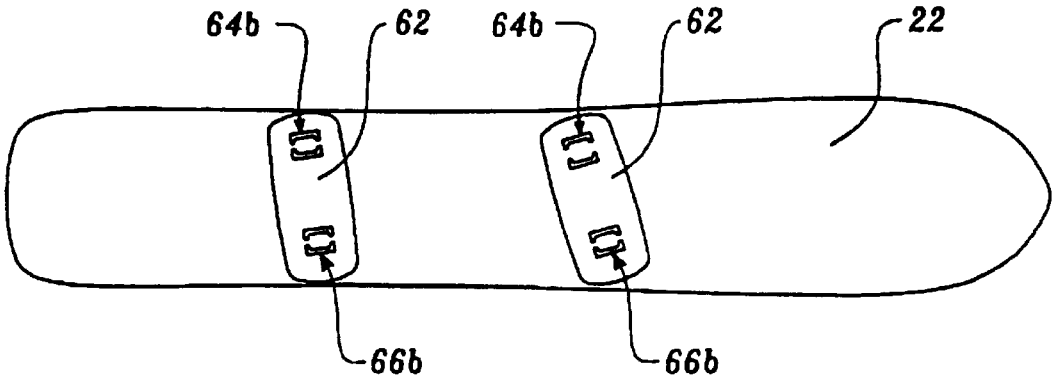
FIG. 6B is a top view of a snowboard illustrating another embodiment of the bindings.
Figure 6C:
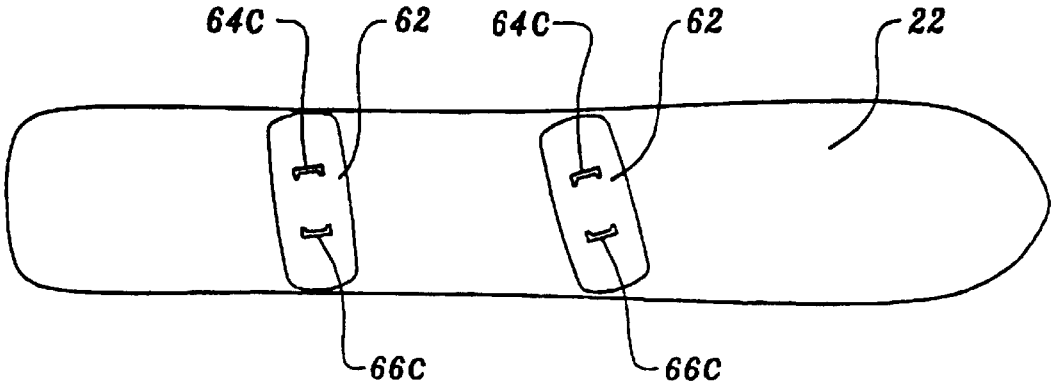
FIG. 6C is a top view of a snowboard illustrating an embodiment of the bindings to be used with the boot shown in FIG. 4B.

FIGS. 6A, 6B, and 6C illustrate one type of binding in three different arrangements that may be used in connection with boot 20 of the present invention. The bindings shown are step-in bindings similar in some ways to step-in ski bindings. A binding plate 62 is fastened to snowboard 22. Binding plate 62 is large enough for most of tread 34 to fit thereon. Toe bindings 64 and heel bindings 66 are fastened to binding plates 62. Toe and heel bindings are spring-biased jaws that engage boot plates 58 to hold boot 20 in place. The jaws of bindings 64 and 66 grip around the edges of boot plates 58 and limit the movement of boot plates 58 in all directions.

The arrangement shown in FIG. 6A may be used when base 24 of boot 20 is rigid enough to hold the forward and rearward boot plates 58 at a constant distance apart. A less rigid base 24 may be used with bindings 64*b* and 66*b*, illustrated in FIG. 6B, since forward and rearward plates 58 are held on all sides by individual bindings. FIG. 6C illustrates an arrangement of bindings 64*c* and 66*c* for attachment to a single boot plate 58*c*, as illustrated in FIG. 4B. One toe binding 64*c* attaches to the front of boot plate 58*c* and one heel binding 66*c* attaches to the rear of boot plate 58*c*. Other arrangements are obviously possible. Currently available plate bindings may also be used to hold boot 20 to snowboard 22. For this purpose ridges could be provided at the toe and heel of boot 20 to receive the toe and heel bails of such conventional plate bindings, such as those made by Emery or Burton, to be used with mountaineering-type boots. A less rigid base 24 for boot 20 may be desirable for comfortable walking when not snowboarding.

Figure 7:
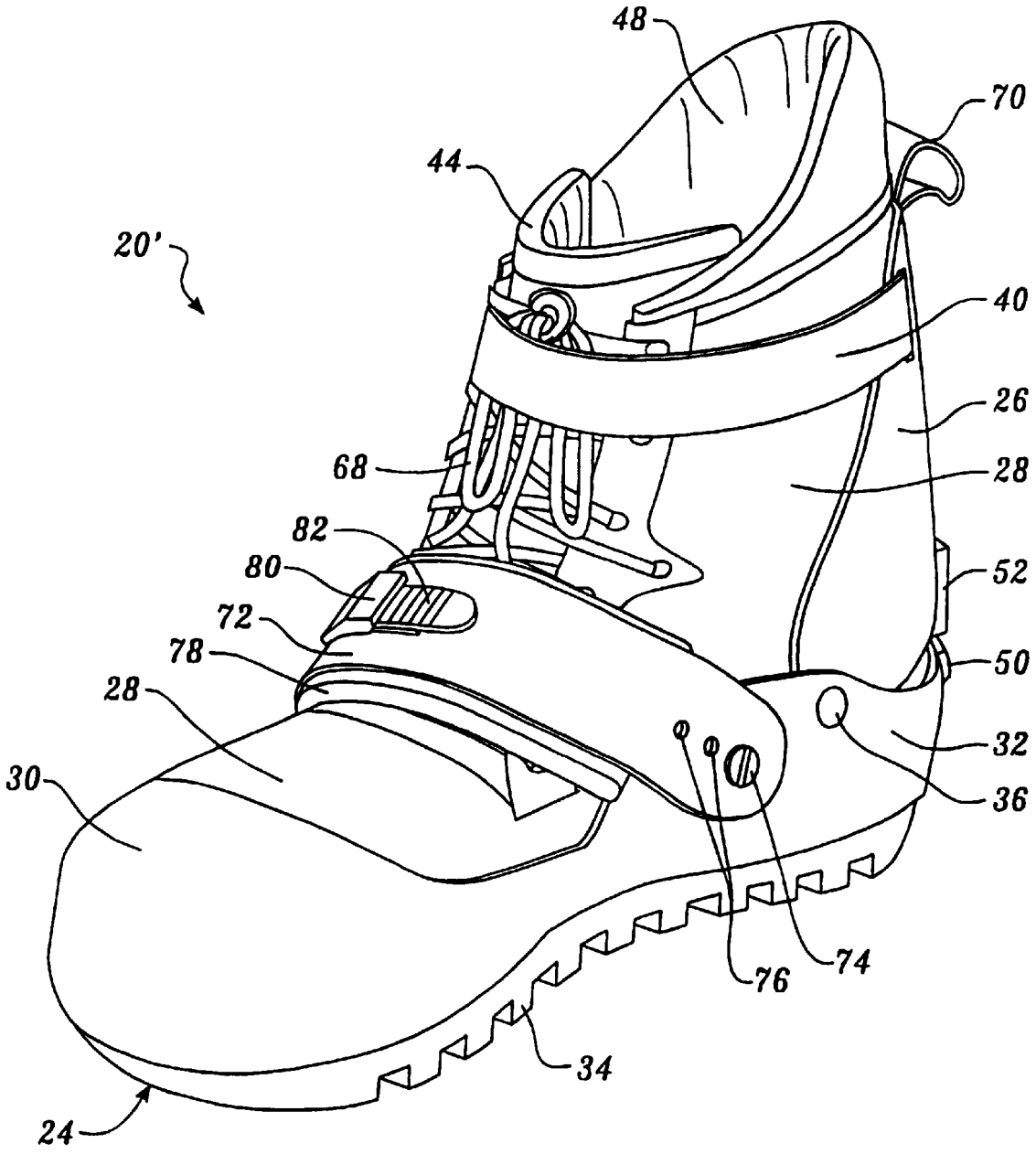
FIG. 7 is a perspective view of another embodiment of the boot of the present invention including both base and highback straps.
Figure 8:
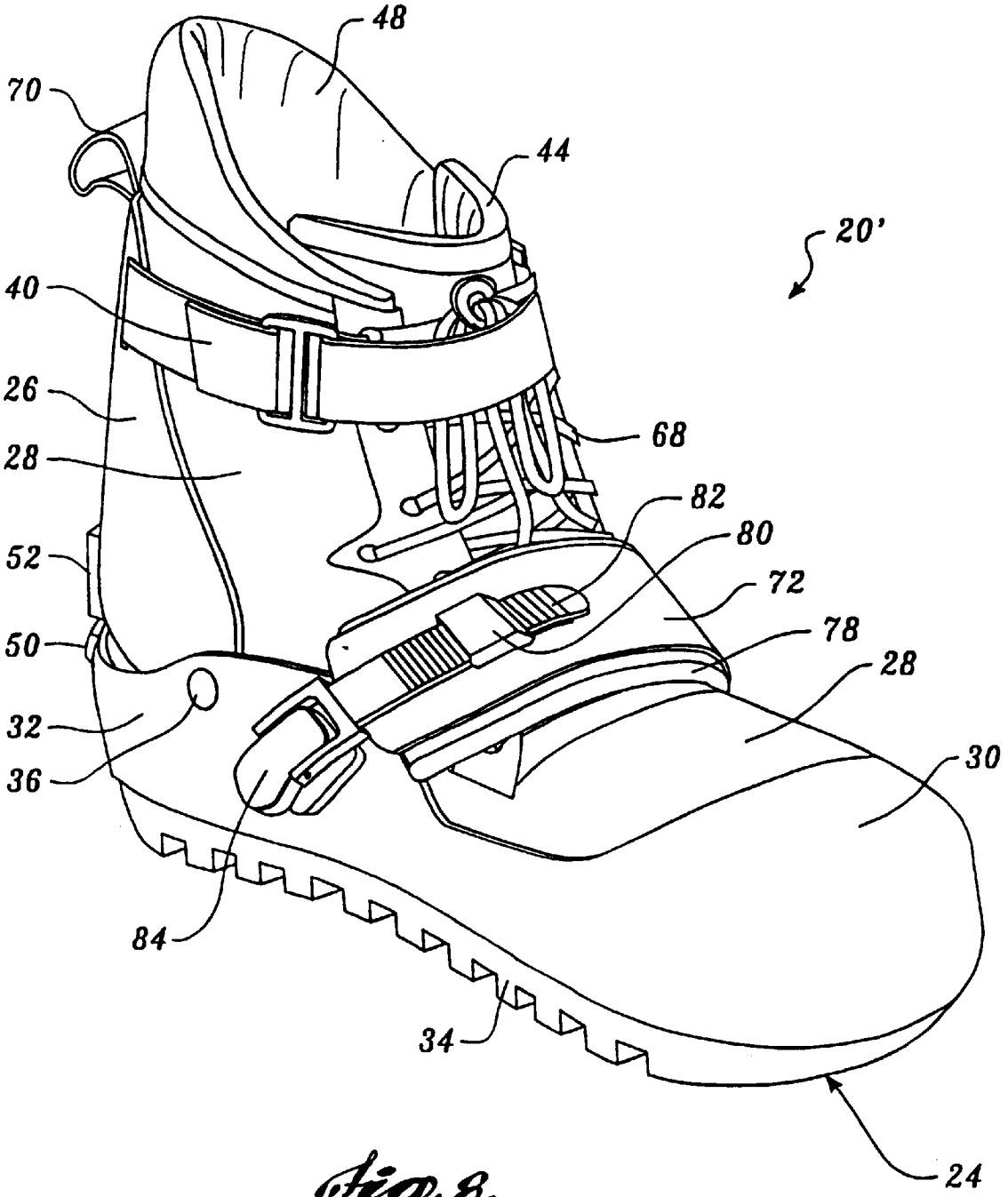
FIG. 8 is a perspective view of the boot illustrated in FIG. 7, showing the opposite side of the boot.
Figure 9:
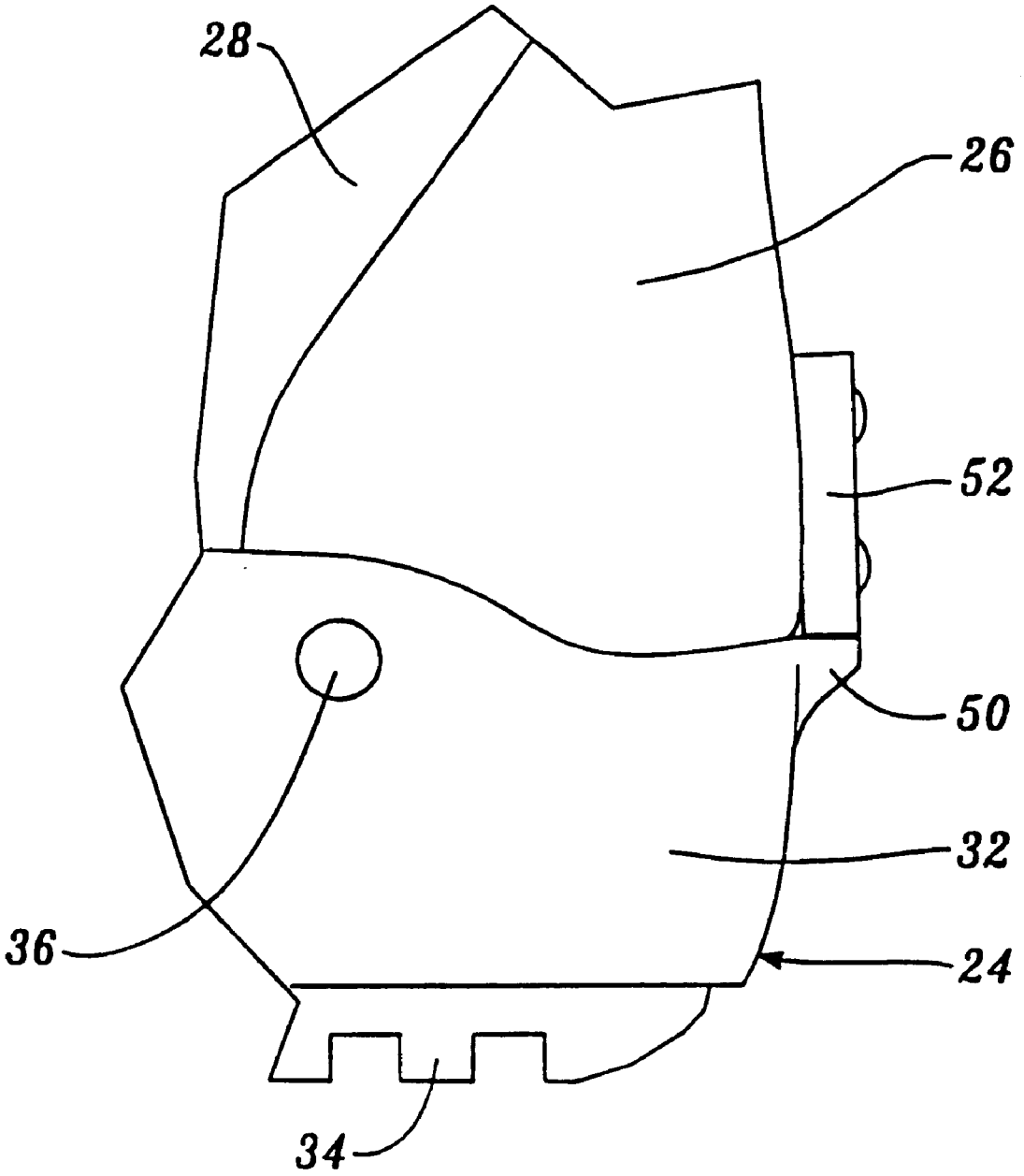
FIG. 9 is a side elevational view of the heel of the boot of FIGS. 7 and 8, illustrating the back stops that limit aft movement of the highback.

An alternate embodiment of boot 20 is illustrated in FIGS. 7 through 9. The major differences between this embodiment and that illustrated in FIGS. 1 through 3 will now be discussed. Besides its generally bulkier appearance, due to increased insulation and thickness of materials for added durability, boot 20' also includes exposed laces 68, a loop 70, and a base strap 72. Although a lace cover could alternatively be used, laces 68 are exposed and extend to the top of upper 28 of boot 20'. Loop 70 is attached to the back of upper 28. Loop 70 is preferably formed of leather. The function of loop 70 is simply to aid the user in putting on boot 20'.

Boot 20' also includes base strap 72 connected to the opposing sides of base 24 and extending over the top of upper 28 in front of the ankle of the user. Heel counter 32 actually extends forward for attachment of base strap 72. Heel counter 32 distributes the pressure to the heel end of base 24 of boot 20' A strap fastener 74 secures base strap 72 on the inside and a buckle 84, ratchet 80, and serrated base strap 82 secure base strap 72 on the outside. Strap fastener 74 is a standard screw fit within a receiving sleeve (not shown) engaged within base 24. Adjustment holes 76 are provided along the end of base strap 72 for major adjustments of base strap 72 by fastening a different hole with strap fastener 74. Base strap 72 is preferably constructed of a strong plastic or composite material, but may alternatively be metal, leather, or other material that can withstand the forces involved. Strap padding 78 is attached to the underside of base strap 72. Strap padding 78 is formed from foam with a urethane cover.

Buckle 84 is riveted to the opposite side of heel counter 32. Buckle 84 secures serrated base strap 82 and provides leverage for tightening base strap 72. Alternatively, other types of buckles or tightening devices could be used. With the buckle arrangement shown in FIG. 8, base strap 72 is tightened by elevating buckle 84, sliding serrated base strap 82 a desired distance within ratchet 80, and closing buckle 84.

Another difference between boot 20' illustrated in FIG. 7 and boot 20, illustrated in FIGS. 1 through 3, is the configuration of highback 26. Highback 26 of boot 20' does not have a cuff extending around the front of upper 28. This allows for more lateral flexibility of boot 20', while still providing complete aft support. Some additional support to upper 28 is provided by highback strap 40, which, in this embodiment, is simply a strap with a hook-and-loop fastener extending from slots in highback 26. Highback 26 slightly recedes from the sides of tipper 28 as highback 26 extends upwardly along the back of upper 28 to allow increased lateral flexibility.

FIG. 9 illustrates the back of boot 20' and shows stop block 52 and bottom lip 50 in greater detail. Stop block 52 and bottom lip 50 are substantially the same in the embodiment shown in FIGS. 1 through 3. Stop block 52 is held with two fasteners that can be undone for removal or reversal of block 52. Block 52 extends farther from the holes on one side than the other such that reversal changes the forward-lean angle of highback 26. Other conventional forward-lean adjustment systems may also be used.

Figure 10:
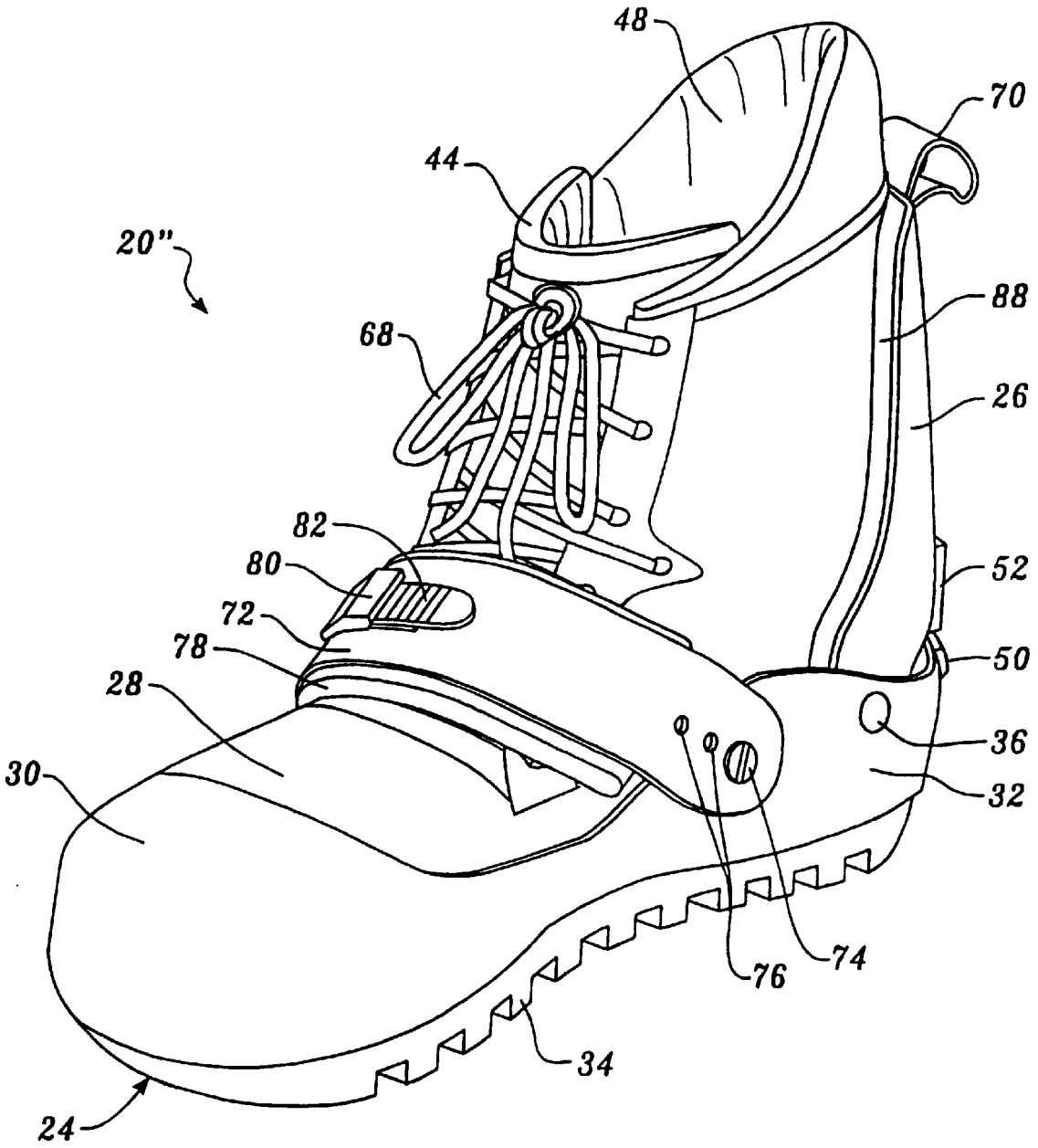
FIG. 10 is a perspective view of an alternate embodiment of the boot of the present invention having no highback strap.

Referring now to FIG. 10, another alternate embodiment of the present invention will be discussed. Boot 20" illustrated in FIG. 10 varies from boot 20' of FIG. 7 by changes made to highback 26. Highback 26 does not include a strap and does not extend as far around the side of upper 28. Thus, greater lateral flexibility is provided. Highback pivot 36 is also shifted slightly farther toward the rearward end of heel counter 32. Highback padding 88 is attached to the inside surface of highback 26 of boot 20". Highback padding 88 could be added to any embodiment disclosed herein.

Figure 11:
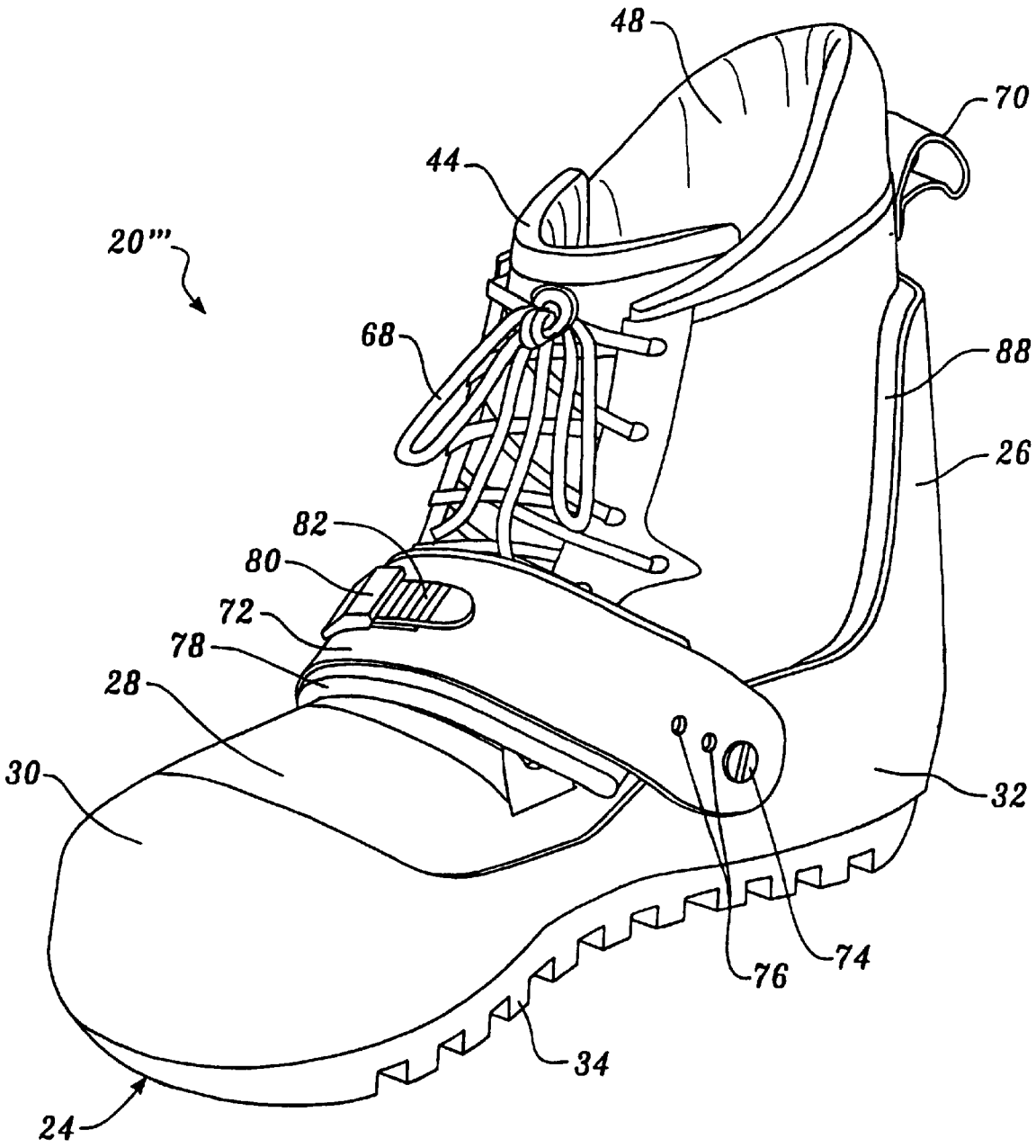
FIG. 11 is a perspective view of another alternate embodiment of the boot of the present invention having an integral highback.

FIG. 11 illustrates another embodiment of the present invention. In this embodiment highback 26 is an integral extension of heel counter 32, instead of being hingeably attached to heel counter 32. A high degree of lateral movement is allowed, while aft movement is restricted by highback 26. A highback strap, such as that illustrated in FIG. 7, may be added to increase lateral stiffness as desired. Bottom lip 50 and stop block 52 are not used with the integral highback structure.

An embodiment of the binding of the present invention will now be described with reference to FIGS. 12–15. Three modifications of that preferred design will then be discussed with reference to FIGS. 16–20.

Figure 12:
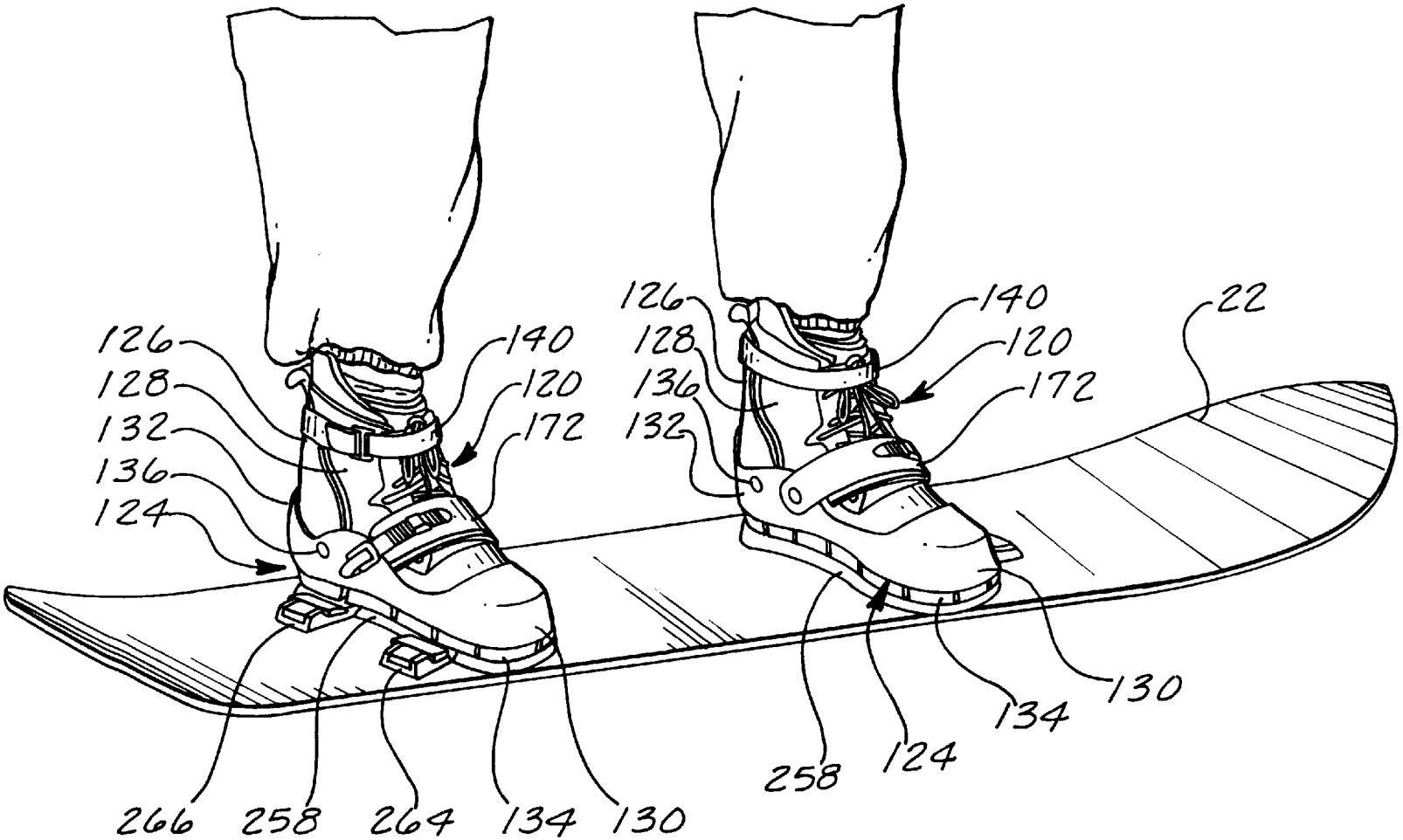
FIG. 12 is a perspective view of one embodiment of the snowboard boots and bindings, showing the boots attached to a snowboard with the bindings.

Boots 120 are shown secured to snowboard 22 in FIG. 12. Boots 120 are similar to those described above with reference to FIG. 8. Each of boots 120 includes a base 124, a highback 126, an upper 128, a toecap 130, a heel counter 132, tread 134, and a highback strap 140. The base and tread make up the sole. These numbers correspond to the numbers described with reference to FIG. 8, except that a "1" has been added in front of like two-digit numbers in FIG. 8. Thus, the elements of the boot in this embodiment are generally numbered between 100 and 199.

The elements of the binding of this embodiment are numbered in the 200s. The binding includes a binding plate 262, a toe binding 264, and a heel binding 266. The boot plate is secured to snowboard 22 beneath the area over which boot 120 rests when attached to toe and heel bindings 264 and 266. Portions of toe and heel bindings 264 and 266 extend laterally outward from the outer sides of binding plates 262.

Figure 13:
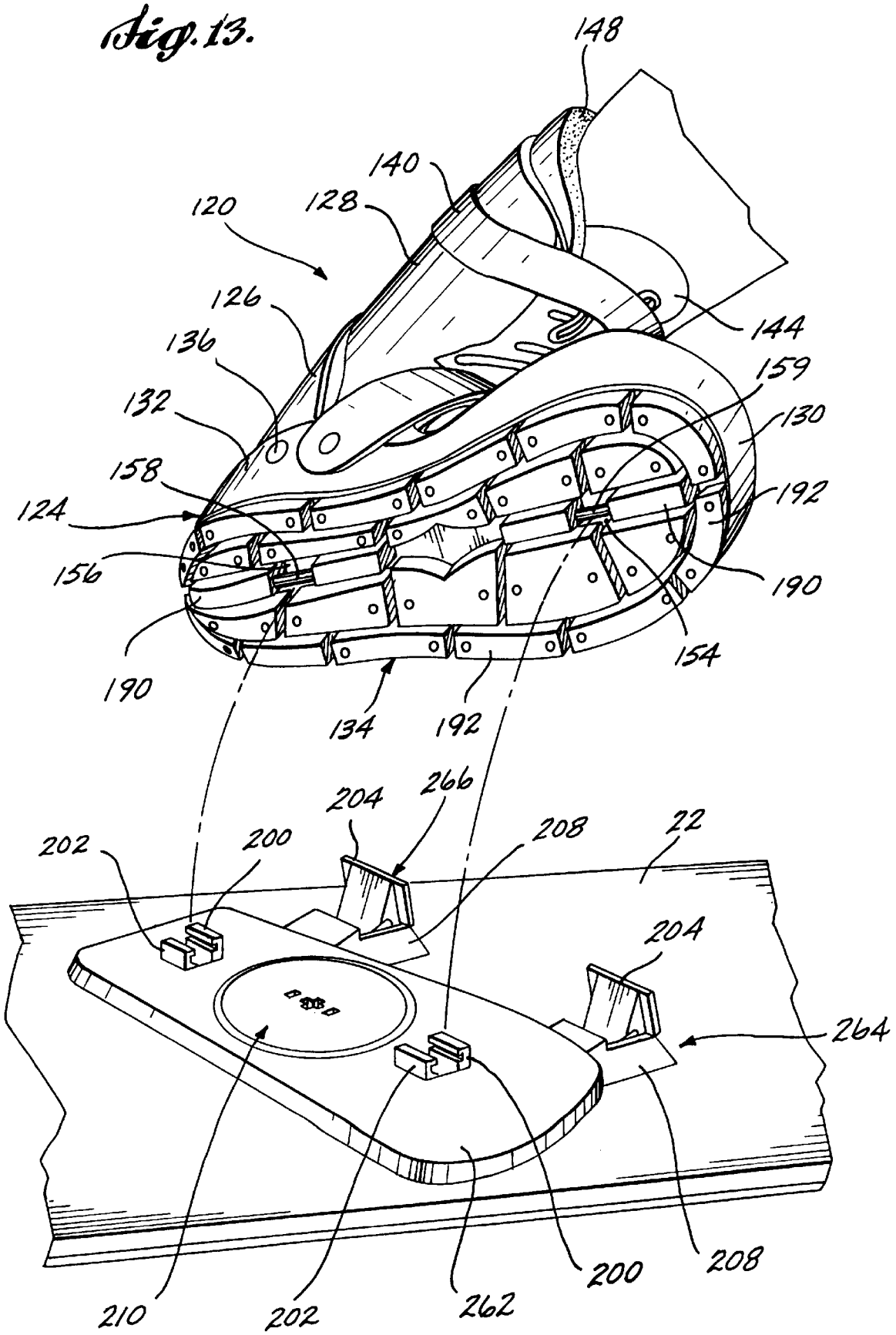
FIG. 13 is a perspective view of the bottom of the boot showing its alignment with one embodiment of the snowboard bindings.

FIG. 13 illustrates the basic elements of the bottom of boot 120 as well as toe and heel bindings 264 and 266. Tread 134 of boot 120 is constructed of numerous flex pads 192 that are secured to base 124 of boot 120. Flex pads 192 are preferably constructed of a deformable resilient rubber-like material. Thus, flex pads 192 may be slightly compressed when sufficient force is applied to them against binding plate 262. Flex pads 192 include a stiffer layer on their upper sides for secure attachment to base 124. The compressibility of flex pads 192 allows for lateral and medial movement of boot 120 about the attachment of boot 120 to toe and heel bindings 264 and 266. Since flex pads 192 are preferably removably attached to base 124, flex pads of differing durometers may be attached to achieve a desired amount of medial and lateral flex or pivotal movement about the attachment of boot 120 to toe and heel bindings 264 and 266. Flex pads 192 of greater thicknesses may also be employed to change the cant of boot 120.

A toe rod 159 and a heel rod 158 are secured between flex pads 192 to base 124 of boot 120. Toe rod 159 and heel rod 158 are preferably constructed of steel rods that extend along the same axis, generally parallel and along the longitudinal axis of the sole of boot 120. Rods 158 and 159 are secured to base 124 with supports or blocks 190. Blocks 190 are preferably parallelepiped in shape and lie along the same axis as rods 158 and 159. Blocks 190 may be of a higher durometer than that of flex pads 192, since pivotal movement of boot 120 about rods 158 and 159 will be about the same axis. In other words, boot 120 may rock or pivot on blocks 190. Blocks 190 are secured in front of and behind each of rods 158 and 159 such that they form a substantial ridge along the longitudinal center of the sole of boot 120.

Binding plate 262 is secured to snowboard 22 in a preferred orientation and is held down in that orientation by an adjustment plate 210. Adjustment plate 210 is secured with screws to snowboard 22, as described in further detail below in conjunction with FIG. 20. Binding plate 262 forms a surface upon which flex pads 192 rest and are compressed.

Toe and heel bindings 264 and 266 in this embodiment are identical. Each includes a static or stationary jaw 200 and an active or movable jaw 202, which clamp onto rods 158 and 159. Static jaw 200 remains in place and provides a recess into which active jaw 202 may extend when closed. Static jaw 200 projects upwardly from binding plate 262 a sufficient distance that it may project within one of recesses 156 and 154 surrounding rods 158 and 159, respectively. Static jaw 200 projects within one side of the recess, while active jaw 202 projects within the other side so as to surround the rod. The upper portion of static jaw 200 is C shaped while the upper portion of active jaw 202 is in the shape of an inverted L. Active jaw 202 thus engages static jaw 200 when closed to completely surround the rod over which it is secured. A lever 204 is used to move active jaw 202 in a lateral or medial direction with respect to boot 120. In FIG. 13 levers 204 are shown in an open position such that active jaws 202 are separated from static jaws 200.

Figure 14:
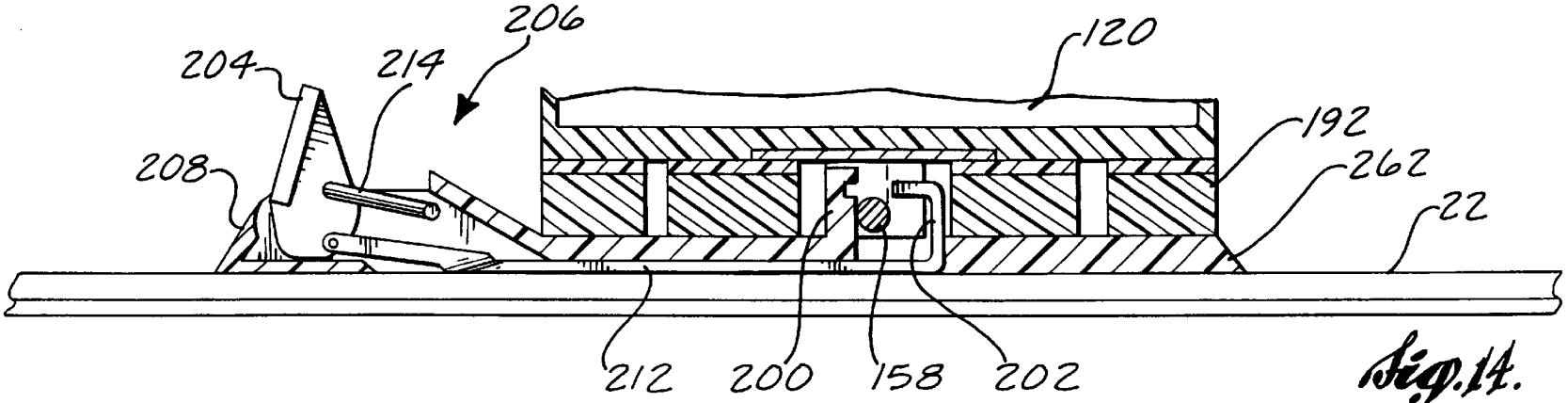
FIG. 14 is a cross-sectional elevational view of one embodiment of a binding shown in an open position.
Figure 15:
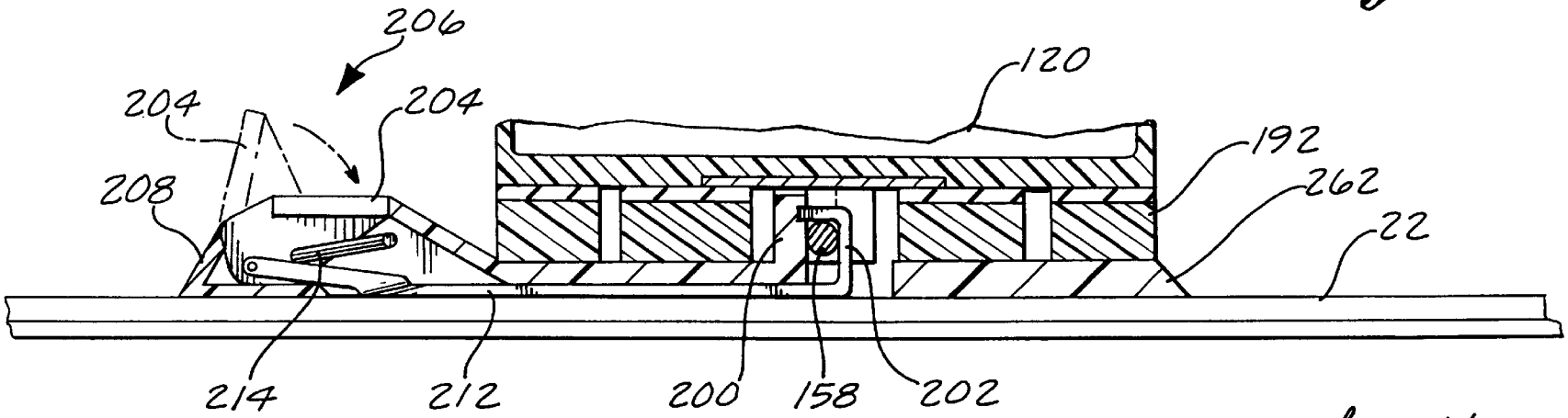
FIG. 15 is a cross-sectional elevational view of the binding illustrated in FIG. 14 shown in a closed position.

FIGS. 14 and 15 illustrate the binding mechanism 206 of both the toe binding 264 and the heel binding 266. As seen in FIG. 14, when active jaw 202 is in an open position relative to static jaw 200, a sufficient space is created between the jaws such that rod 158 can fit between them. Thus, lever 204 is in the up position, allowing the boot to be inserted between the jaws before being secured by the binding. The binding mechanism includes a housing 208, lever 204, linkage 214, slide plate 212, and jaws 200 and 202. Lever 204 is pivotally connected to linkage 214 at approximately the middle of lever 204. Linkage 214 is also pivotally connected, at its other end, to housing 208. The bottom end of linkage 204 is pivotally connected to slide plate 212. Slide plate 212 extends from the bottom portion of lever 204 beneath a portion of housing 208 and integrally connects with active jaw 202. Movement of lever 204 pivots lever 204 about its pivotal connection to linkage 214, which is held in place by its connection to housing 208. Movement of lever 204 thus translates slide plate 212 in a lateral or medial direction to open or close active jaw 202 relative to static jaw 200. Static jaw 200 may be an integral portion of housing 208 and preferably extends upwardly therefrom, as explained above.

The closed position of binding mechanism 206 is illustrated in FIG. 15. Lever 204 has been pressed downwardly, thus pulling slide plate 212 in a lateral direction and thereby closing active jaw 202 around rod 158. Rod 158 is thus held captive between static jaw 200 and active jaw 202. The C-shaped recess into which the end of active jaw 202 rests also helps to counter any upward forces applied against active jaw 202 by rod 158. As lever 204 is closed, the pivotal connections of linkage 214 and slide plate 212 to lever 204 initially cause lever 204 to pass an overcenter position, such that the closed position is maintained when force is applied to active jaw 202. Thus, the pivotal connection of slide plate 212 to lever 204 is such that it is above the axis of linkage 214.

Figure 16:
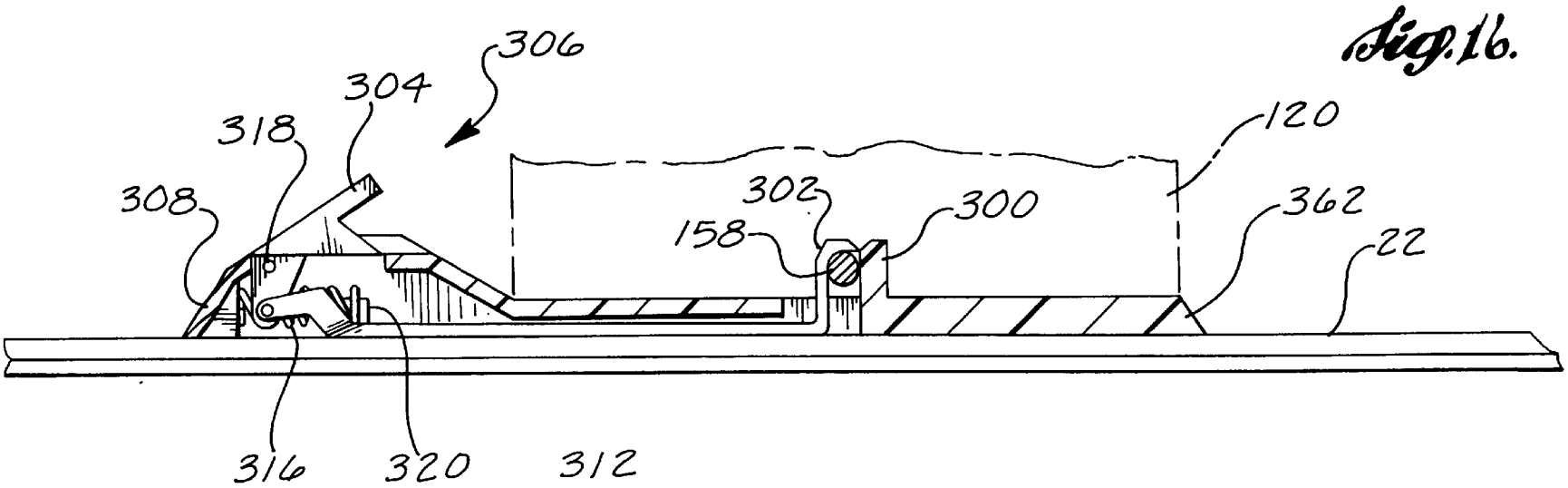
FIG. 16 is a cross-sectional elevational view of another embodiment of a binding shown in a closed position.
Figure 17:
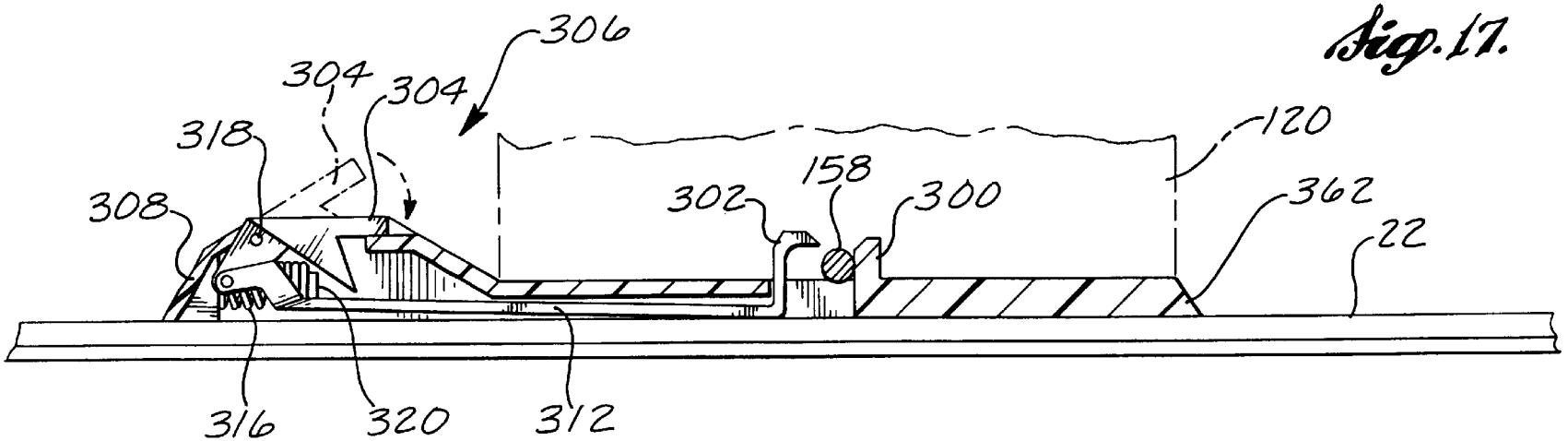
FIG. 17 is a cross-sectional elevational view of the binding illustrated in FIG. 16 shown in an open position.

FIGS. 16 and 17 show an alternate mechanism that may be used with the same boot 120. Binding mechanism 306 includes a lever 304 pivotally attached with a pivot pin 318 at its lateral side to housing 308. Lever 304 is pivotally attached at its bottom end to slide plate 312. Slide plate 312 includes an upwardly projecting tab 321 inward of its pivotal connection to lever 304. A cylindrical helical compression spring 316 is disposed between tab 320 and housing 308. Thus, as lever 304 is pressed downwardly, slide plate 312 moves laterally and tab 320 compresses spring 316. Thus, slide plate 312 is biased in a medial direction by spring 316 pressing against tab 320. In this binding mechanism 306, an active jaw 302 is on the lateral side of rod 158 and a passive jaw 300 is on the medial side. Thus, slide plate 312 extends beneath housing 308 and connects to active jaw 302, which projects upwardly through housing 308 on the lateral side of rod 158. To attach boot 120 to binding mechanism 306, rod 158 is simply pressed between active jaw 302 and static jaw 300. An inwardly facing downward angle is provided on the top of both static jaw 300 and active jaw 302, such that a V shape is formed into which rod 158 may be pressed. As rod 158 is pressed into this V shape, a lateral force is applied to jaw 302 and, thus, slide plate 312, such that jaw 302 moves away from static jaw 300 to provide an opening for rod 158 to fit within. Once rod 158 extends beneath the upper portion of jaw 302, jaw 302 is free to close over rod 158 and enclose rod 158 between jaw 302 and static jaw 300. No corresponding V exists on the underside of active jaw 302. Therefore, upward pressure by rod 158 does not cause active jaw 302 to open. Active jaw 302 is opened by pressing downwardly on lever 304 such that spring 316 is compressed and slide plate 312 pulls active jaw 302 away from static jaw 300.

Figure 18:
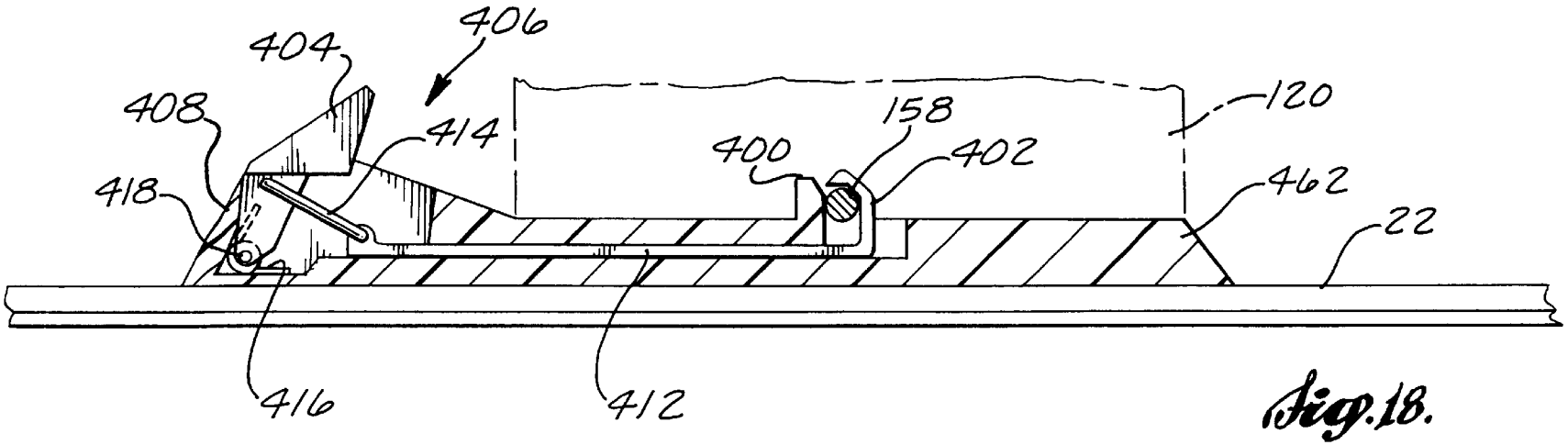
FIG. 18 is a cross-sectional elevational view of another embodiment of a snowboard binding shown in a closed position.
Figure 19:
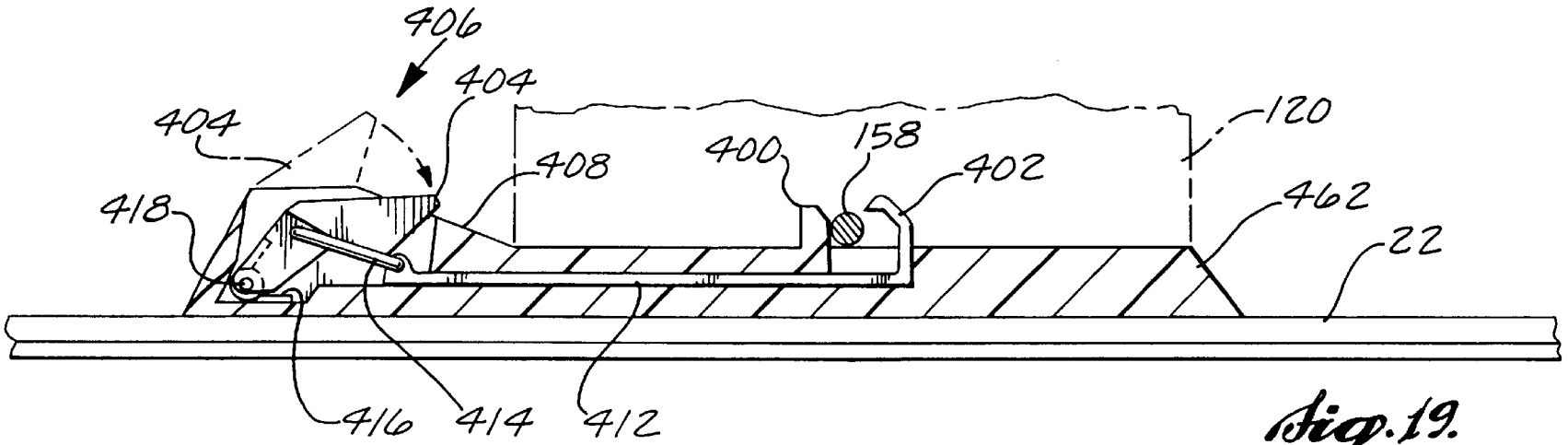
FIG. 19 is a cross-sectional elevational view of the binding illustrated in FIG. 18 shown in an open position.

Another preferred embodiment of a binding mechanism 406 is illustrated in FIGS. 18 and 19. Binding mechanism 406 includes a lever 404 pivotally attached to a housing 408 at its bottom end. A spring 416 is coiled around a pivot pin 418 that pivotally holds lever 404. The ends of spring 416 exert an upward force on lever 404 and a downward force on housing 408. Spring 416 is loaded in a direction perpendicular to its coiled axis, while spring 316 illustrated in FIGS. 16 and 17 is loaded along its longitudinal axis through the center of the coils. A linkage 414 is pivotally coupled to the center of lever 404 and pivotally coupled at its opposite end to a slide plate 412. Slide plate 412 extends within housing 408 beneath a static jaw 400 to integrally connect with active jaw 402. Active jaw 402 extends upwardly from slide plate 412 and includes a hook to surround rod 158. The ends of static jaw 400 and active jaw 402 form a V shape similar to that discussed above with respect to FIGS. 16 and 17. Thus, as rod 158 is pressed against static jaw 400 and active jaw 402, the V separates and allows rod 158 to be enclosed between active jaw 402 and static jaw 400. In this embodiment active jaw 402 is on the medial side of rod 158 while static jaw 400 is on the lateral side.

As illustrated in FIG. 19, as lever 404 is pressed downwardly, linkage 414 moves slide plate 412 in a medial direction to open jaws 400 and 402. Boot 120 can then be removed from binding mechanism 406.

Figure 20:
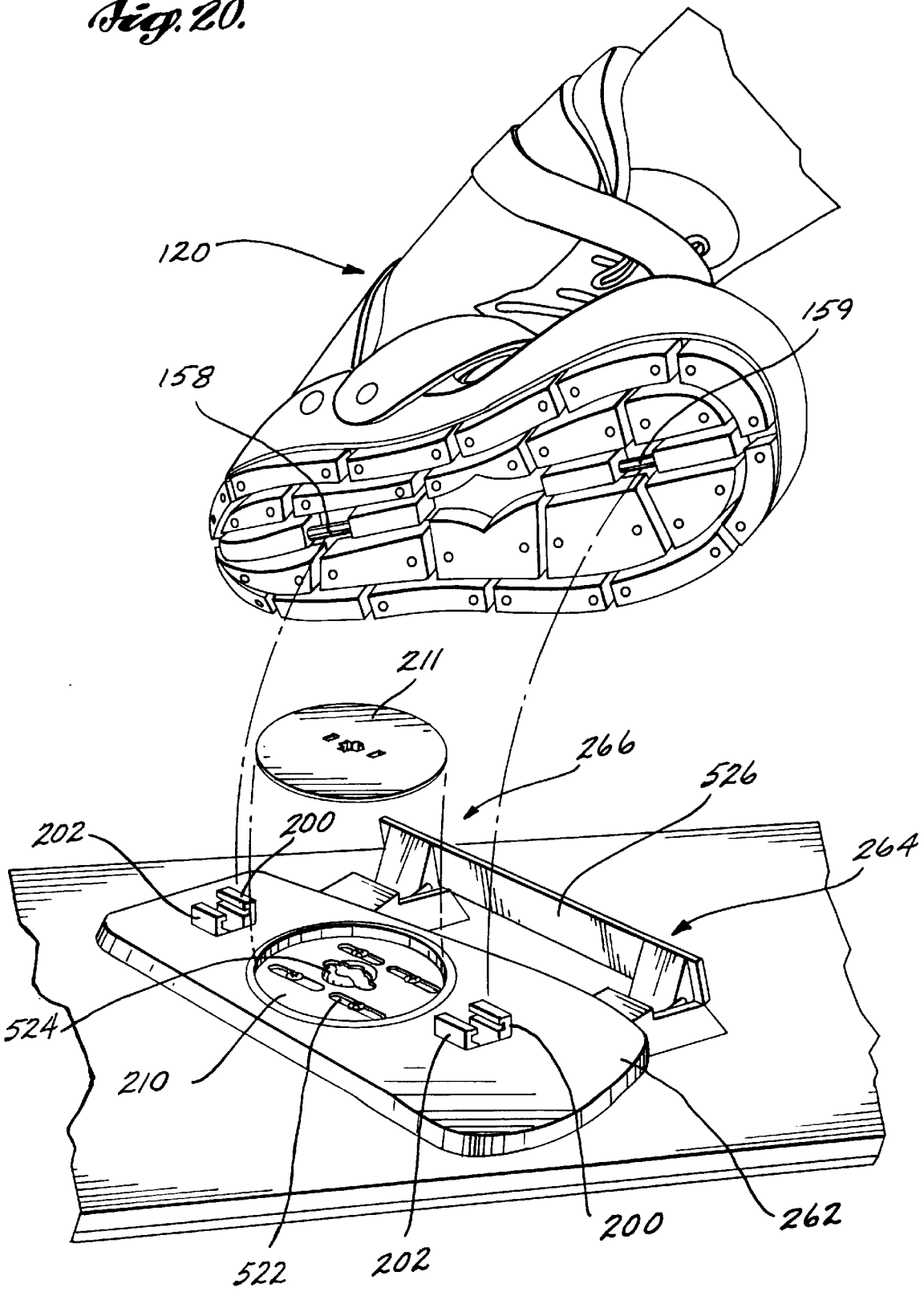
FIG. 20 is a perspective view showing the bottom of a snowboard boot above one embodiment of a snowboard binding having simultaneously opening forward and rearward coupling jaws.

FIG. 20 illustrates a slight modification to toe and heel bindings 264 and 266. In this embodiment, a bar 526 extends between the levers of toe and heel bindings 264 and 266 such that both may be opened and closed together. Also illustrated in FIG. 20 is further detail of adjustment plate 210. Adjustment plate 210 includes a cover 211 that fits into a center slot 224. Cover 211 simply covers slots 522 and screws that fit within slots 522 to secure adjustment plate 210 and, thus, binding plate 262 to snowboard 22. The positioning of binding plate 262 can be adjusted by loosening adjustment plate 210 and rotating the entire binding plate, along with toe and heel bindings 264 and 266, around adjustment plate 210. Adjustment plate 210 is circular to allow this rotation. Binding plate 262 may be shifted in a fore or aft direction by loosening screws within slots 522 and shifting adjustment plate 210 in a forward or aft direction, the screws sliding within slots 522.

Any of the described binding embodiments could be used with the above-described boot or, alternatively, with a boot not having a highback, the highback being attached to the binding frame, as is done with cantilevered freestyle snowboard bindings.

Another preferred embodiment of a boot and binding incorporating many of the aspects of the bindings described above, but with a few modifications, will now be described in connection with FIGS. 21–25. This binding includes a toe binding 664 that is different from the heel binding 666. Toe binding 664 is constructed primarily of a hook 650. Heel binding 666 is similar in many regards to binding mechanism 406, illustrated in FIGS. 18 and 19 and described above. Heel binding 666 includes a static jaw 600 and an active jaw 602. Angled portions are provided on the tops of these jaws to form a V shape such that the jaws will separate as boot 720 is pushed down over them.

The basic structure of this alternate binding is formed with the heel binding being held by a rearward bridge 632 that spans the width of the heel of the boot and a forward bridge 634 that spans beneath the boot under the ball of the foot. Forward bridge 634 and rearward bridge 632 are coupled together with side rails 628. Side rails 628 are generally vertical or perpendicular to snowboard 22 and are secured to snowboard 22 with attachment plates 630, which project outwardly and perpendicularly from side rails 628.

Side rails 628 and attachment plates 630 are each formed integrally, preferably of aluminum. The aluminum forms a cross-sectional L shape with side rails 628 being generally rectangular and having their longitudinal axes parallel to the surface of snowboard 22. Each attachment plate 630 lies flat on snowboard 22 and is straight along one edge of connection to side rails 628 and curves outwardly along the other edge, the ends of the outer edge meeting side rails 628. An adjustment slot 622 is provided on each attachment plate 630. Adjustment slot 622 is a segment of a circle approximately concentric with the center of the entire binding mechanism. Screws 646 are provided and engaged within adjustment slots 622 to secure attachment plate 630 and thus the entire binding structure to snowboard 22. Thus, the entire mechanism may be pivotally moved by loosening screws 646, which secure attachment plates 630 to snowboard 22.

Side rails 628 include mounting holes 642 through which forward and rearward bridges 634 and 632 may be secured. Rearward bridge 632 includes flanges 636 at its outer ends for securement to side rails 628. Flanges 636 project upwardly from the outer ends of rearward bridge 632 to lie flat against side rails 628. Holes are also provided within flanges 636 such that fasteners 640 can secure rearward bridge 632 to side rails 628. Flanges 638 are likewise provided on the ends of forward bridge 634 and perform a similar function for forward bridge 634 as flanges 636 perform for rearward bridge 632.

Forward bridge 634 is generally parallelepiped in shape. The height of forward bridge 634 is preferably only a few millimeters, while the bridge length spans beyond the width of a forward portion of the boot to connect to side rails 628. The width of forward bridge 634 is preferably only a few centimeters. A ridge 648 is preferably provided along the center of forward bridge 634 parallel to the longitudinal axis of forward bridge 634. Ridge 648 helps to locate the boot onto toe binding 664. Hook 650 projects upwardly from ridge 648 and is preferably formed of two substantially flat plate-like portions. The first portion projects upwardly and a second portion forms the rearwardly projecting hook portion.

The rearward bridge similarly spans side rails 628. It has a height that is only a few millimeters and a width slightly larger than that of forward bridge 634. As explained in more detail below, a retraction link 644 is provided to open active jaw 602.

Figure 22:
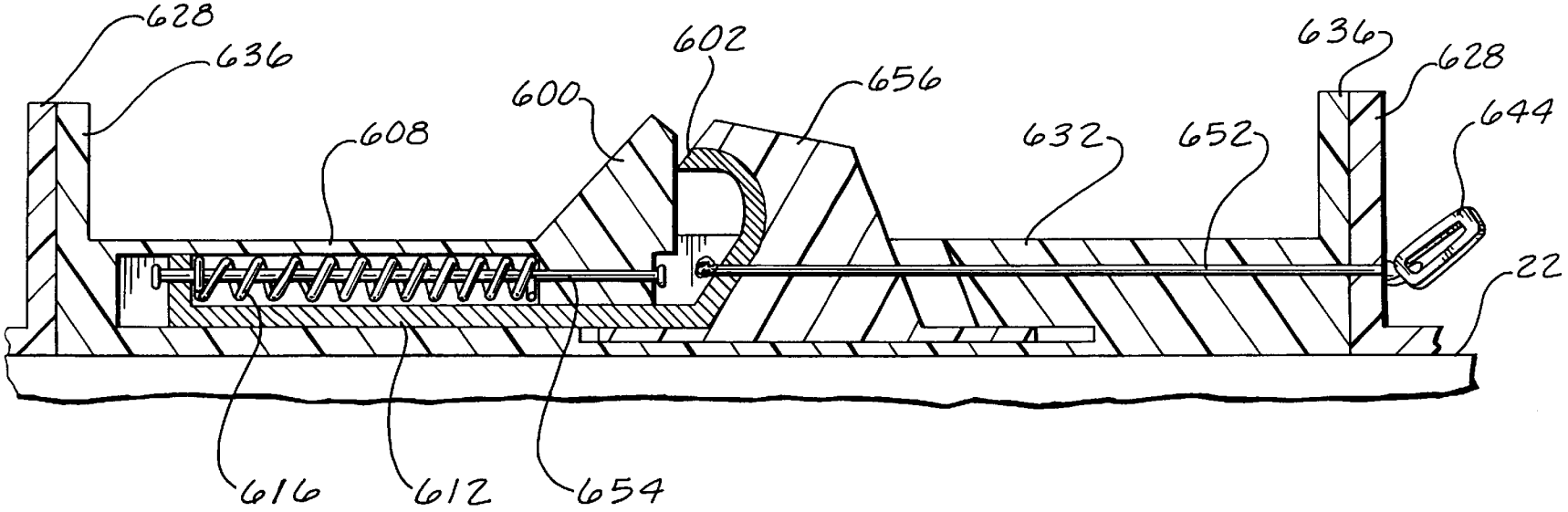
FIG. 22 is a cross-sectional elevational view of the rear coupling mechanism of the binding illustrated in FIG. 21.

FIG. 22 illustrates the details of heel bindings 666. Active jaw 602 includes a jaw sheath 656 having a generally A-shaped configuration on the back side of active jaw 602. Static jaw 600 is similar to that discussed above in conjunction with FIGS. 18 and 19. Active jaw 602 projects upwardly through housing 608 and bends in the direction of static jaw 600 to form an enclosure for securing heel rod 659 discussed below. A slide plate extends from the lower portion of active jaw 602 in a medial direction within housing 608. The end of slide plate 612 projects upwardly to secure a cylindrical, helical spring between the upwardly projecting end of slide plate 612 and housing 608 beneath static jaw 600. A guide rod 654 is provided along the axis of spring 616. Spring 616 is a compression spring that biases active jaw 602 in a closed direction against static jaw 600. Active jaw 602 may be opened by pulling on retraction link 644. Retraction link 644 is pivotally coupled to a retraction arm 652 that extends within housing 608 to link with active jaw 602. Thus, as retraction link 644 is pulled in a lateral direction, spring 616 is compressed and active jaw 602 is separated from static jaw 600 to allow the snowboard boot to be released from heel binding 666. A cord may be attached to retraction link 644 to aid in grasping and pulling retraction arm 652.

Figure 21:
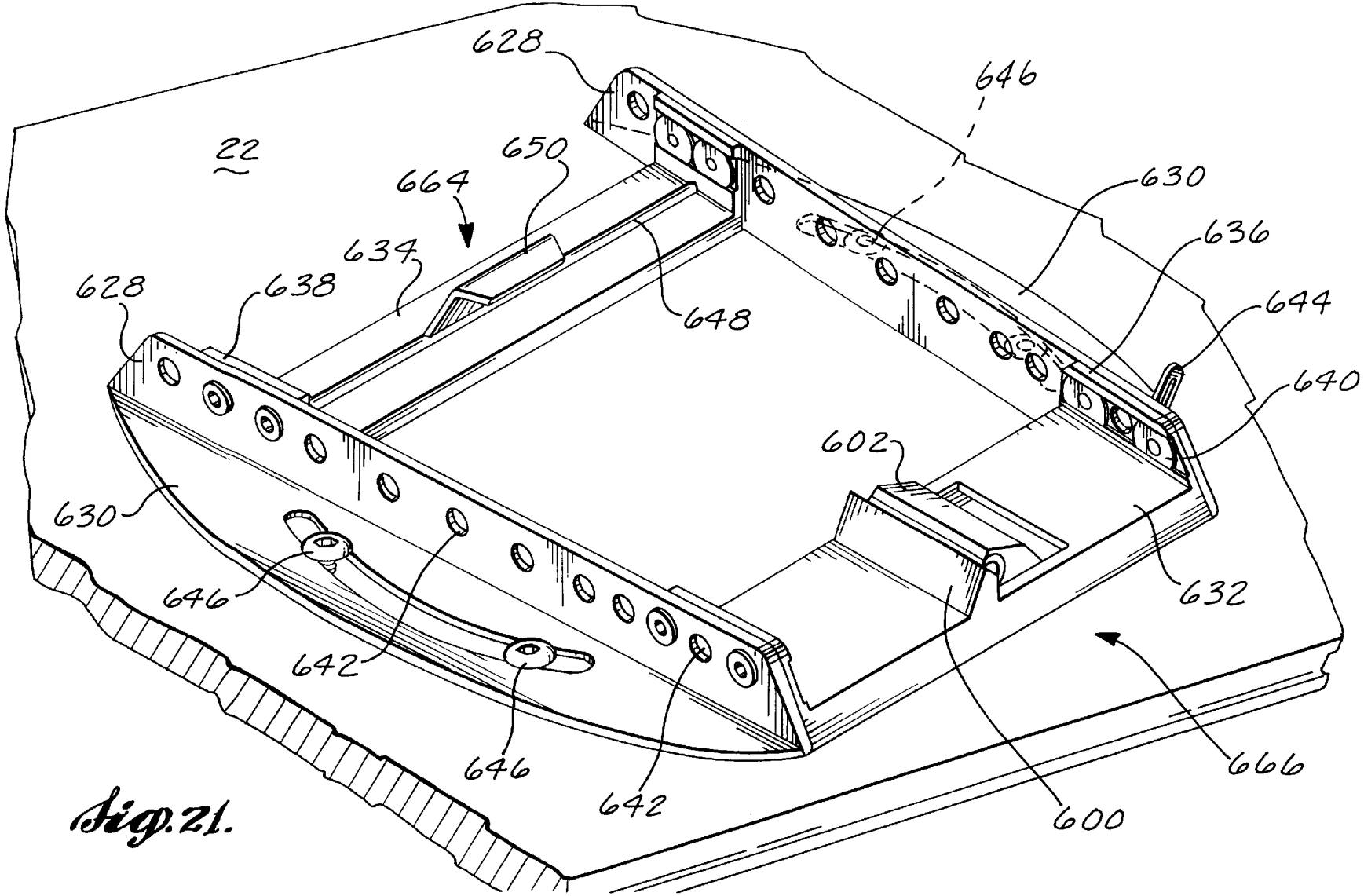
FIG. 21 is a perspective view of another embodiment of a snowboard binding of the present invention illustrating the binding as attached to a snowboard.

It should be understood that, while the binding mechanism shown in FIG. 22 is preferably used with the entire binding illustrated in FIG. 21, any of the above-described binding mechanisms could alternatively be used. Furthermore, alternate arrangements and other binding mechanisms could also be used that hold the heel of the boot in place.

Figure 23:
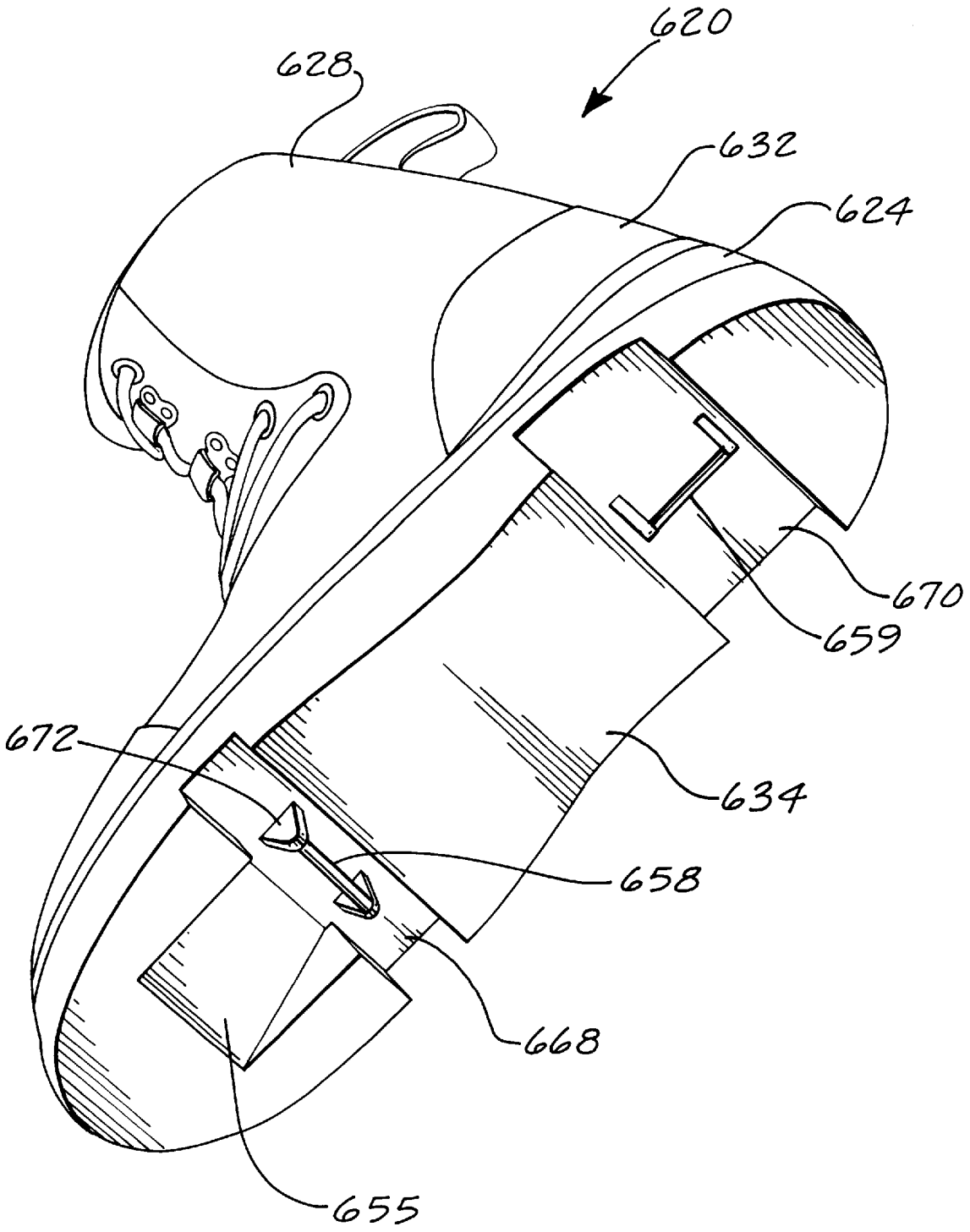
FIG. 23 is a perspective view of the underside of a snowboard boot made for coupling with the binding illustrated in FIG. 21.

The details of boot 720 that are relevant to the above-described binding will now be discussed with reference to FIG. 23. Boot 720 includes an upper 728, a heel counter 732, and a base 724. A tread 734 is attached to base 724 and makes up the sole of boot 720. A rearward recess is provided beneath the heel of boot 720 and is arranged and configured to ride over rearward bridge 632. Thus, rearward recess 770 extends across the heel portion of sole 734. Likewise, a forward recess 768 is provided under a forward portion of the boot corresponding to the ball of the foot. Forward recess 768 also includes a sloped portion 755 that angles up from the bottom of forward recess 768. Sloped portion 755 allows hook 650 to slide within it to be secured to a toe rod 758. Toe rod 758 is secured with rod supports 772 within forward recess 768. Toe rod 758 is preferably oriented transverse to the longitudinal axis of sole 734 such that it can be received by hook 650. Heel rod 759 is secured within rearward recess 770 and is oriented, generally parallel, to the longitudinal axis of sole 734.

Figure 24:
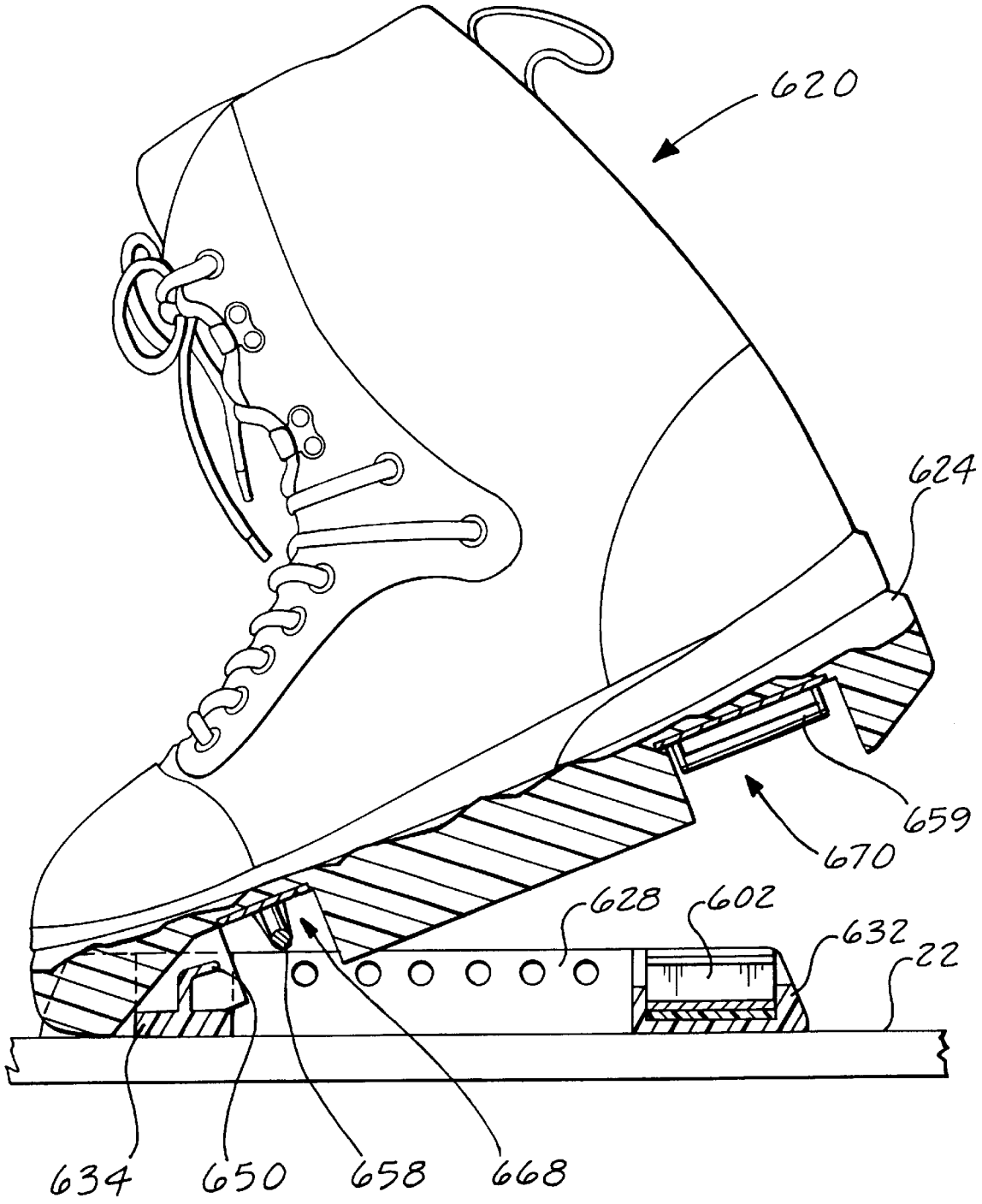
FIG. 24 is a cross-sectional elevational view of the snowboard boot illustrated in FIG. 23 and the snowboard binding illustrated in FIG. 21, showing the boot being positioned for attachment to the binding.
Figure 25:
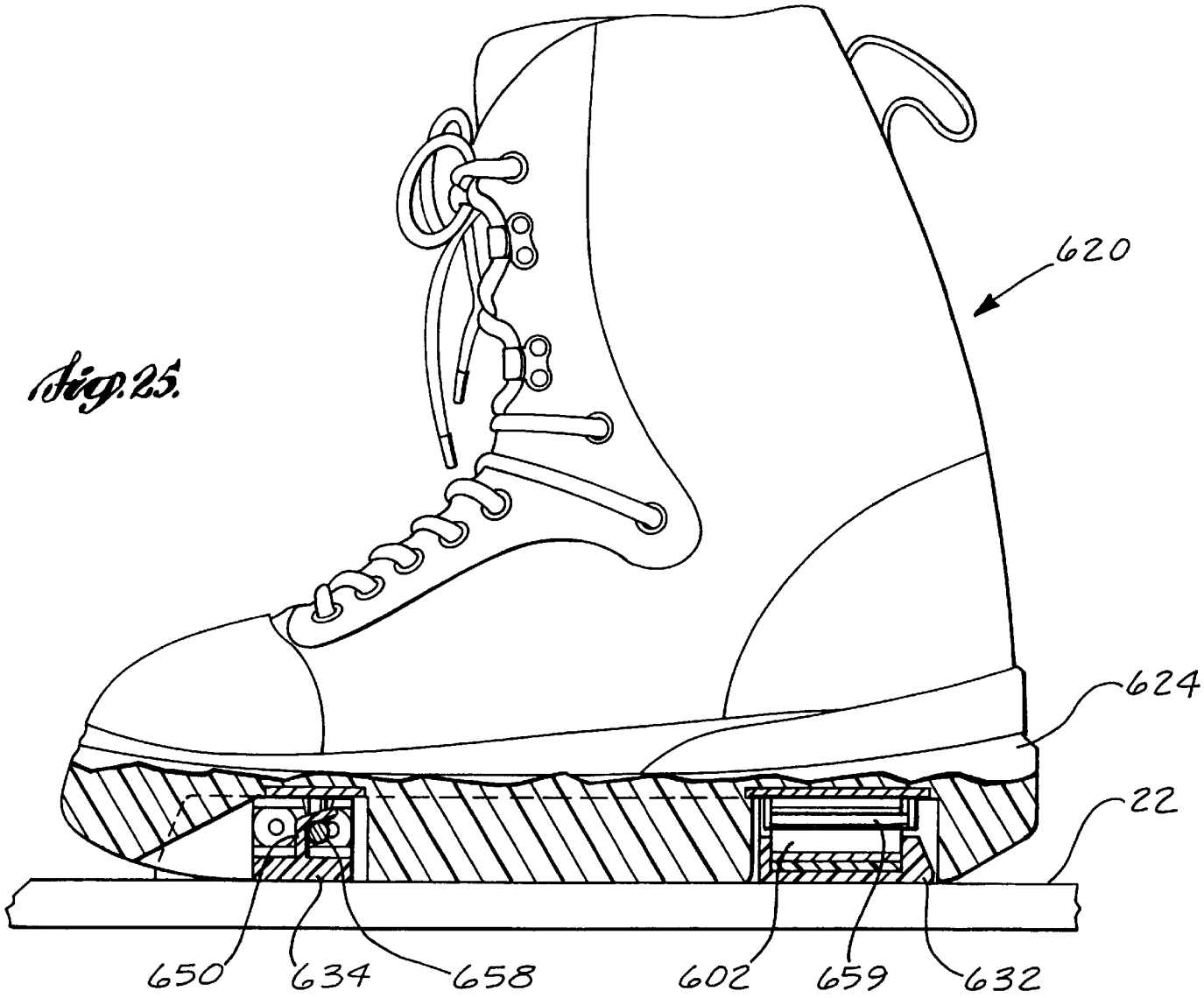
FIG. 25 is a partial cross-sectional elevational view showing the boot and binding of FIG. 24 in a secure position on the snowboard.

FIGS. 24 and 25 illustrate the insertion of boot 720 into the binding. The toe of the boot is placed over hook 650 such that hook 650 is within sloped portion 755. The boot is slid forward to a position where rod 758 is beneath hook 650 and forward bridge 634 is within forward recess 768. In this position, heel rod 759 is directly over jaws 600 and 602, and rearward recess 770 is over rearward bridge 632. The heel of the boot is then pressed downwardly to open active jaw 602 and allow rod 759 to be enclosed between active jaw 602 and static jaw 600. Thus, the position illustrated in FIG. 25 is assumed and rearward recess 770 encloses rearward bridge 632. Boot 720 is held in this position until retraction link 644 is pulled, such that active jaw 602 moves away from static jaw 600 to allow the heel of boot 720 to be lifted and the boot to be removed from the binding.

Thus, the binding described with respect to FIGS. 21–25 has several advantages: the entry and exit into the binding are similar to those employed with a ski boot and binding system. However, the binding clasps the boot beneath the sole of the boot such that the toe and heel of the binding can be at or near the edges of the snowboard to accommodate standard snowboard widths. The buckles or straps of boot 720 do not need to be readjusted to secure or release boot 720 from snowboard 22. The binding mechanism may quickly and easily be released or reattached to boot 720 as desired. Hook 650 functioning as toe binding 664 reduces the complication and thus the expense of the binding mechanism and also adds to the simplicity and ease of use of the binding. Lateral and medial compression of tread 734 is still allowed such that desirable movement can be maintained while providing rearward support to the ankle of the user and adequate securement to snowboard 22 for both carved and freestyle turns.

The arrangement of binding mechanisms such that they may be released from the side is also advantageous, since the toe and/or heel of the boot often extends slightly over the side of the board. The binding may be stepped into and simply released.

Figure 26:
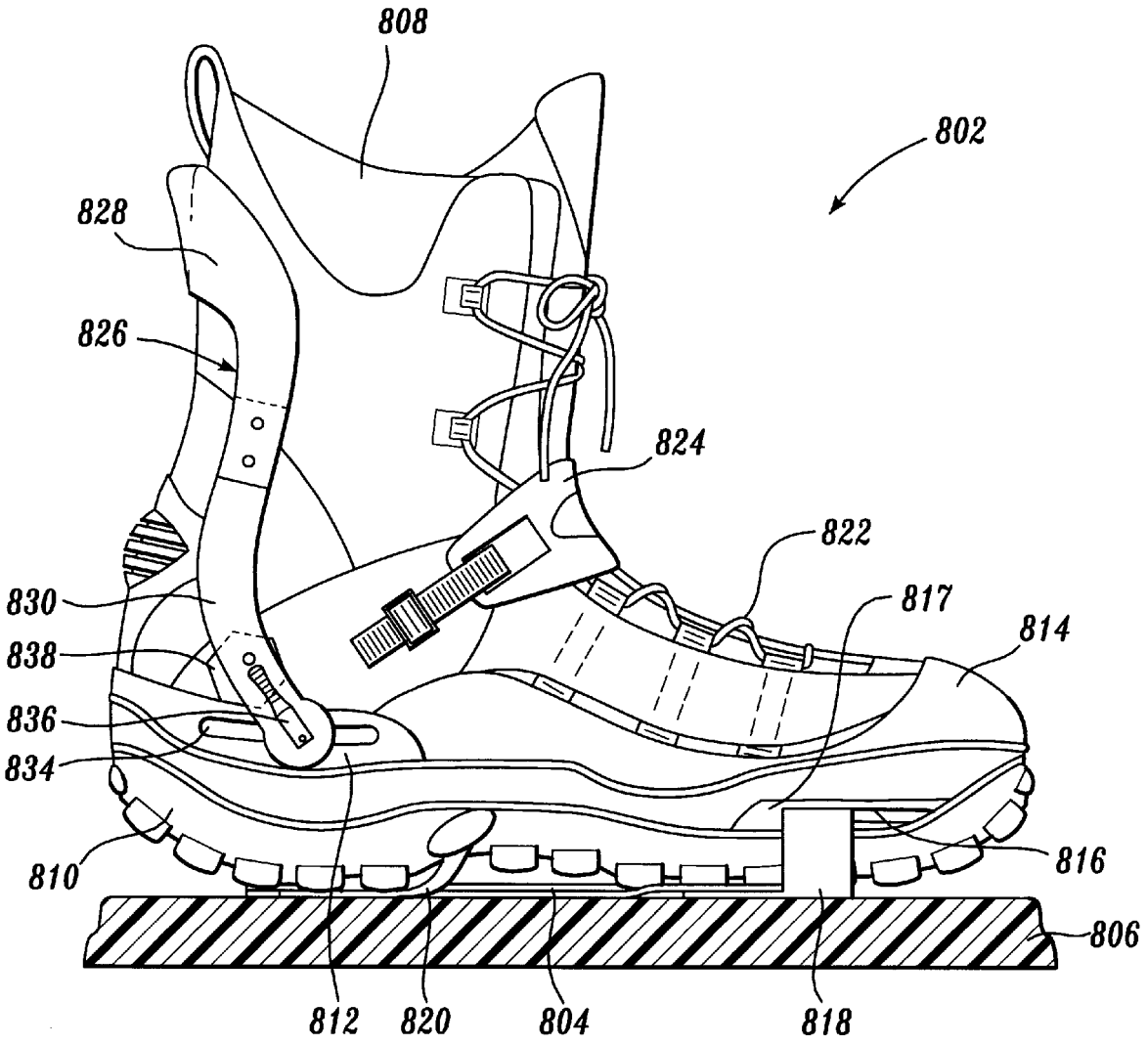
FIG. 26 is a side elevational view of another preferred embodiment of the snowboard boots and bindings showing a boot secured to a snowboard with the binding.
Figure 27:
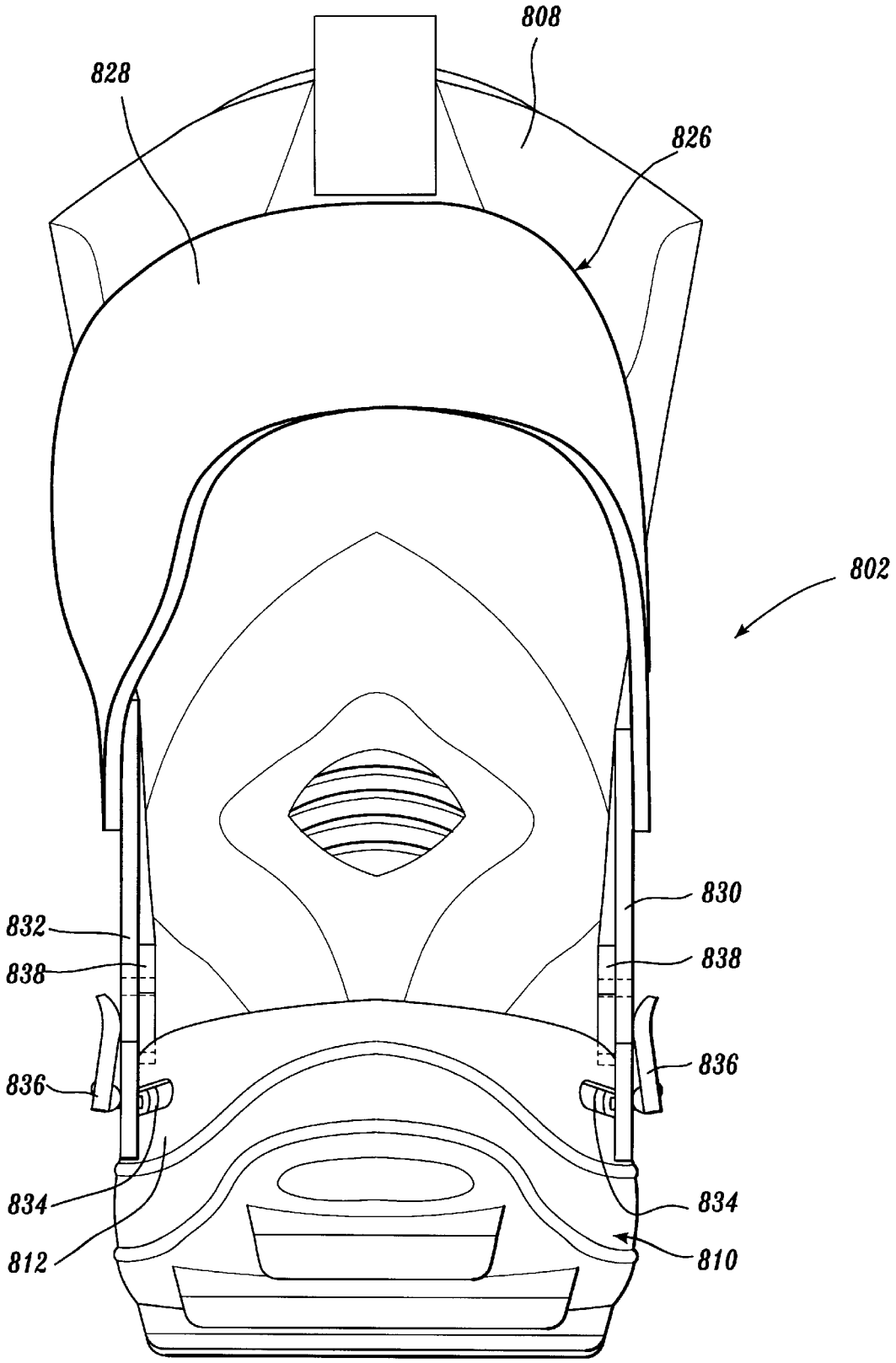
FIG. 27 is a rear elevational view of the boot illustrated in FIG. 26.

Referring now to FIGS. 26 through 35, alternate preferred embodiments of a boot 802 with a binding interface and a binding 804 to be secured to this preferred boot will now be described. As seen in FIGS. 26 and 27, boot 802 is secured to snowboard 806 with binding 804. Boot 802 includes an upper 808 and a sole 810. Upper 808 is preferably constructed of a flexible material such as woven nylon and/or leather. Upper 808 also includes internal padding and is preferably fixedly attached to sole 810. Sole 810 is also flexible much like a hiking boot such that the entire sole is not rigid. This allows for ease of walking when boot 802 is not secured to snowboard 806.

Sole 810 includes a rigid heel counter 812 secured about the heel portion of upper 808. At the forward end of boot 802 a toecap 814 is provided. The toe end of boot 802 also includes toe slots 816 on both the lateral and medial sides. Toe slots 816 are formed within toe slot blocks 817. Blocks 817 are preferably constructed of a somewhat rigid plastic material such as polyethylene or polyurethane. Two blocks may be used within the sole of boot 802, fixedly secured to each side of boot 802. Alternatively, a single block 817 may extend across the width of the toe end of boot 802. Toe slots 816 are recesses within toe blocks 817. Toe slots 816 runs generally perpendicular to the longitudinal axis of sole 810. The forward end of toe slot 816 is open, whereas the rearward end is closed, ending the recess, such that toe slot 816 ends before the rearward end of block 817.

Toe slot 816 engages lateral and medial toe jaws 818 and 819 of binding 804 (see FIG. 7). Toe jaws 818 and 819 project upwardly to engage within toe slots 816 for securing the forward end of boot 802 to snowboard 806. As seen in FIG. 26, binding 804 also includes a lever 820 for release of binding 804 from boot 802. The further details of binding 804 and its interface with boot 802 will be described in further detail below in connection with FIGS. 31 through 35.

Upper 808 of boot 802 includes laces 822 for providing a snug fit on the foot of the wearer of boot 802 in a conventional manner. An ankle strap 824 is also provided. Ankle strap 824 extends from the medial to the lateral side of the ankle portion of boot 802 to seat the heel of the wearer comfortably in place within boot 802 while riding snowboard 806. Ankle strap 824 is preferably attached with a ratchet mechanism to upper 808 for quick release and positive hold.

A strut 826 is provided at the rear portion of boot 802 to provide aft leg and ankle support while riding. Strut 826 is in the shape of an inverted U with the ends being releasably attached to the medial and lateral sides of heel counter 812. Thus, strut 826 restricts the aft flexibility of upper 808 when it comes into contact with strut 826. Strut 826 includes a strut upper portion 828, a strut lower lateral portion 830, and a strut lower medial portion 832. Strut upper portion 828 extends behind a portion of upper 808 that surrounds a lower leg of the wearer. Lateral and medial portions 830 and 832 are connected to the lateral and medial sides of heel counter 812, respectively. Lower portions 830 and 832 project upwardly from heel counter 812 to their connection with upper portion 828 a few centimeters above their connection to heel counter 812. Heel counter 812 includes mounting slots 834 on the lateral and medial sides to which lower portions 830 and 832 are secured. Fasteners 840 (see FIG. 27) are secured with quick release levers 836 through mounting slots 834 and through lateral and medial portions 830 and 832. Quick release levers 836 in the preferred embodiment are over center cam mechanisms with a lever at the end thereof Levers 836 function to release or secure the position of lateral and medial portions 830 and 832 of strut 826.

Forward lean cams 838 are also secured to lateral and medial portions 830 and 832 of strut 826. Forward lean cams 838 are secured to portions 830 and 832 above and behind their attachment to mounting slot 834. Cams 838 are preferably hexagonal in shape with an eccentric pivot that secures them to the inside of strut lower portions 830 and 832. One side face of forward lean cams 838 bears against an upper surface ridge of heel counter 812. Thus, forward lean cam 838 does not allow lower portions 830 and 832 to pivot rearwardly about fasteners 840 once a face of cam 838 bears against the top ridge of heel counter 812. The angle of lower portions 830 and 832 can be changed by rotating forward lean cams 838 such that a different side face of the cams bear against heel counter 812. Cams 838 may be repositioned depending on the riding style preferred by a particular snowboarder or on the type of snowboarding engaged in. For example, additional forward lean may be desirable for carving on hard pack snow surfaces whereas less forward lean may be desirable in deep powder or for certain freestyle maneuvers. A block of another shape may alternatively be used in place of cam 838. Other means of adjusting the forward lean of strut 826 may also be used in place of cam 838 such as an adjustment screw that bears against heel counter 812 and is secured to strut 826.

Figure 28A:
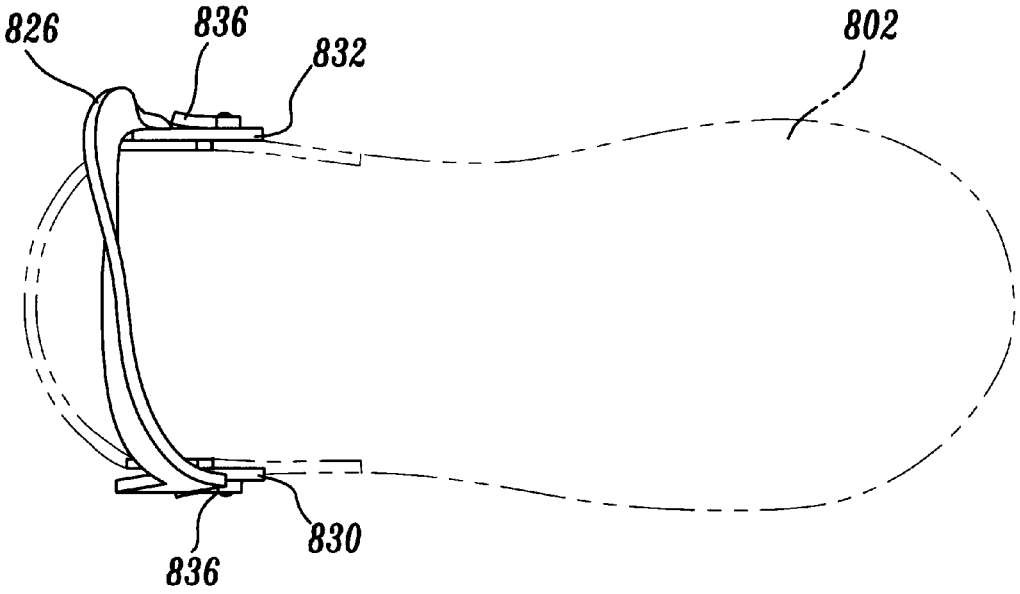
FIG. 28A is a top view of the strut portion of the boot illustrated in FIG. 26.
Figure 28B:
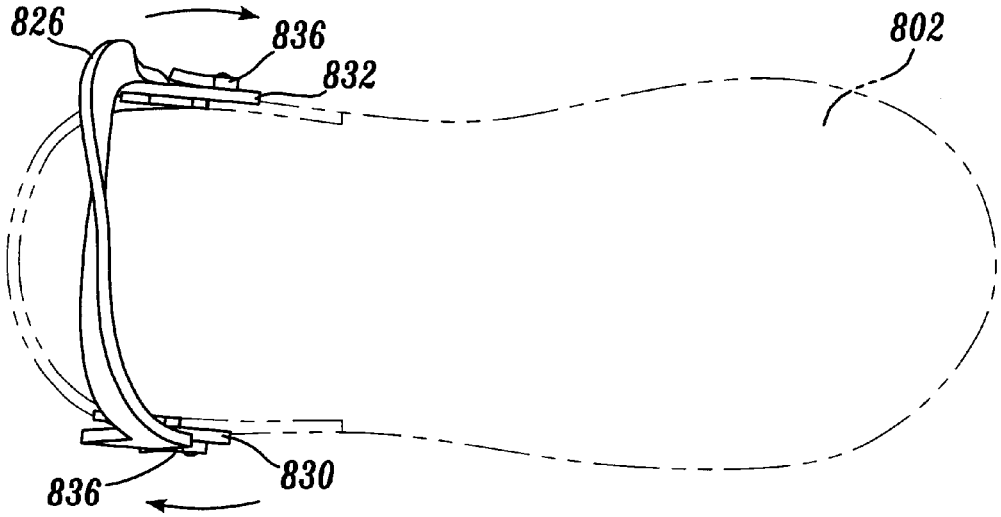
FIG. 28B is a top view of the strut of FIG. 28A shown rotated slightly in a clockwise direction.

Further details of strut 826 are evident in FIGS. 28A and 28B. Strut 826 is asymmetric about a vertical plane extending along the longitudinal axis of boot 802. The medial side of strut 826 does not extend as far forward at the top of upper portion 828 as does the lateral side. Thus, strut 826 is more open on the medial side. This allows additional range of movement in the medial direction for the lower leg portion of upper 808.

Generally, lateral support for snowboarding is more desirable than medial support. Freestyle snowboarders may prefer to have a great amount of medial flexibility to enable them to perform stunts. A snowboarder may lower his or her knee close to the board in the medial direction. However, safety concerns and control are issues requiring adequate lateral support. Thus, some lateral support is desirable to protect the leg and ankle of the user and to provide additional snowboard control. The arrangement of strut 826 attached to heel counter 812 and not fixed to the lower leg portion of upper 808 enables the rider to have maximum flexibility in the desired directions while providing superior support in the aft direction.

The proper amount of lateral support is also desirable. The lateral support may be adjusted to accommodate the riding stance of the snowboarder or personal preference. Quick release levers 836 and sliding fasteners 840 within mounting slots 834 provide this adjustability. In this manner, strut 826 may be effectively pivoted about a vertical axis extending through the heel of boot 802. A slight clockwise rotation is illustrated in FIG. 28B. FIG. 28A illustrates more lateral support and less medial support than the configuration illustrated in FIG. 28B. Increased lateral support may be obtained without decreasing medial support by simply shifting fasteners 840 forwardly within mounting slots 834 while decreasing the forward lean with cams 838. In this manner, both sides of strut 826 are moved fowardly while the portion of strut 826 that extends directly behind the lower leg portion of upper 808 may be reclined rearwardly to maintain its general orientation relative to heel counter 812. In this manner additional cupping is provided for medial and lateral support of upper 808.

Figure 29:
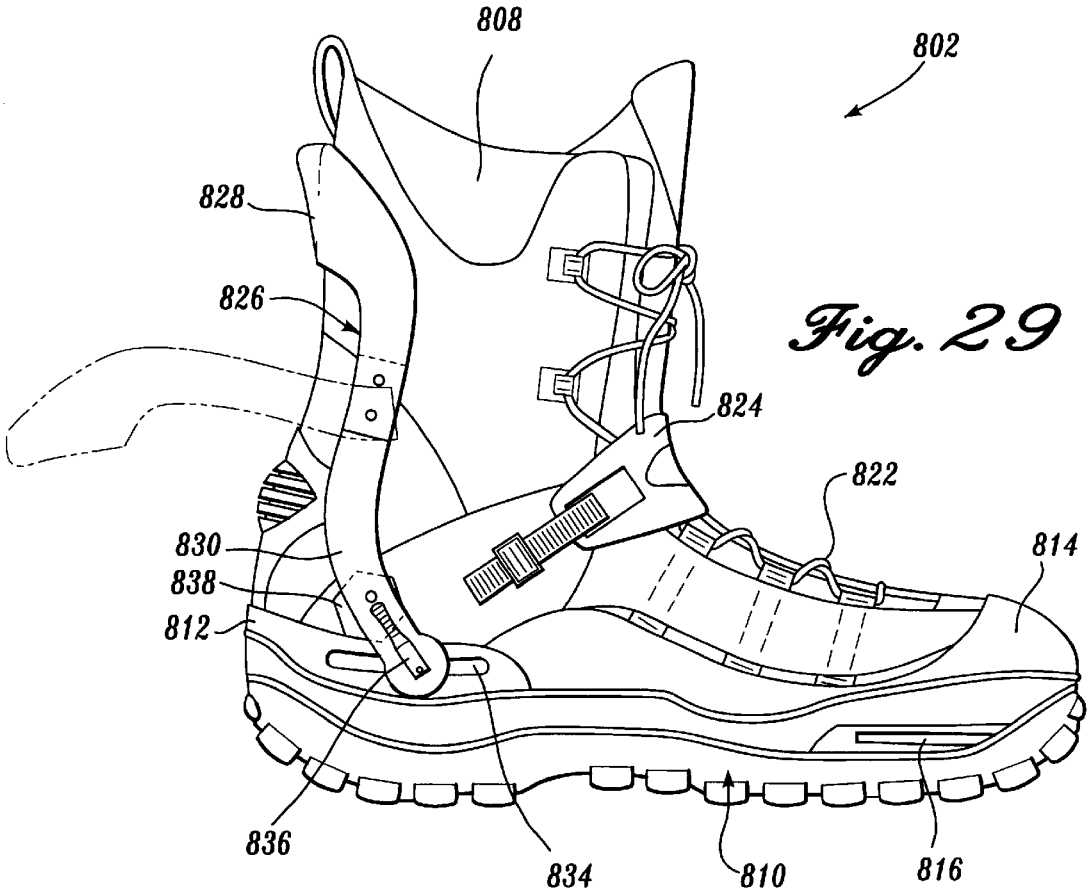
FIG. 29 is a side elevational view of the boot illustrated in FIG. 26 showing the movement of an upper portion of the strut.
Figure 30:
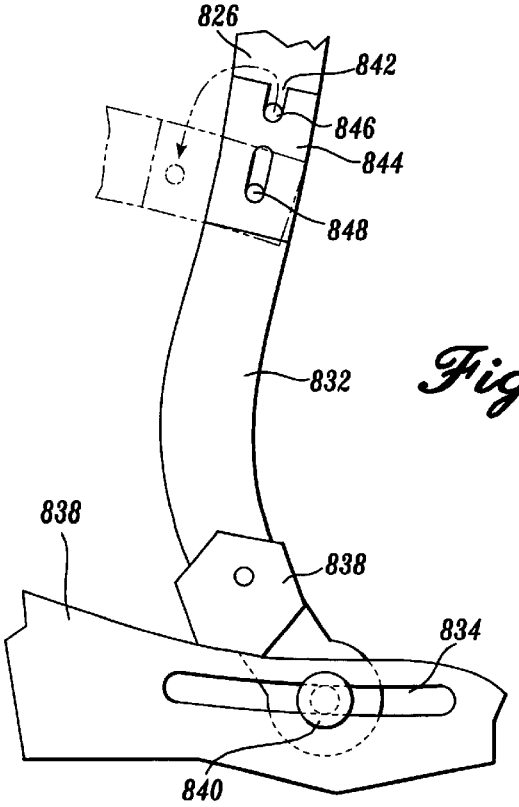
FIG. 30 is a detailed view of the medial side of the strut illustrated in FIG. 29.

Referring now to FIGS. 29 and 30, an additional feature of strut 826 will be described. As discussed above, strut 826 provides aft support to upper 808 of boot 802 for snowboarding. However, when a rider has one or both boots unattached from snowboard 806, it is desirable to have a boot that is comfortable to walk in. Aft support, necessary for snowboarding, is not desirable for walking. Conventional snowboard boots, which do not include integrated aft support, but rely on the snowboard binding highback to provide aft support, are very flexible in the aft direction for walking when not attached to a boot. Riders should have the same comfort with a boot adapted for a step-in binding. Therefore, strut upper portion 828 is pivotally secured to strut lower portions 830 and 832. Strut upper portion 828 may be easily disengaged from an aft support configuration, when desired, by pulling upwardly on strut upper portion 828 and swinging it rearwardly. To this end, strut lower portions 830 and 832 are secured to strut upper portion 828 with a slot and pin arrangement. Strut lower portions 830 and 832 include an oblong slot 844. Strut upper portion 828 includes slot pins 848 that project inwardly from the sides of strut upper portion 828 and engage within strut slots 844. Thus, strut upper portion 828 is slidably interconnected to strut lower portions 830 and 832 for limited vertical displacement relative thereto. In order to lock strut upper portion 828 into a fixed upright position to provide aft support, notches 842 are provided within the upper ends of strut lower portions 830 and 832. Second pins (notch pins 486) are secured above slot pins 488. Notch pins project inwardly from the sides of strut upper portion 828. Notch pins 846 are engaged within notches 842 to prohibit strut upper portion 828 from rotating rearwardly. However, as illustrated in FIG. 30, strut upper portion 828 can be lifted such that slot pins 848 slide upwardly within strut slots 844 and notch pins 846 clear the top of notches 842. Strut upper portion 828 may then be pivoted rearwardly such that no aft support is provided to upper 808 by strut 826. Other mechanisms for locking and releasing strut 826 to allow increased freedom of movement when not snowboarding may also be employed. For example, strut 826 may simply be positioned away from the rear portion of upper 808 by releasing quick release levers 836 and moving cams 838.

The combination of boot 802 with rigid strut 826, which is not attached to the lower leg portion of the boot upper and may be pivoted away from the rearward portion of upper 808, provides optimum flexibility while riding, with strong support where needed. Furthermore, walking in boot 802 when not attached to the snowboard is facilitated such that a boot with all of the advantages of a conventional soft snowboard boot and those of a snowboard with a step-in binding interface are provided without also having the potential disadvantages of either boot.

Another feature that may be incorporated into a strut or highback release system is a binding release mechanism connected to the strut or highback. The connection between the highback and the binding may be, for example, a cable connection. Lifting of upper portion 828 of strut 826, relative to lower portions 830 and 832, would pull the cable to release the binding. Other alternate embodiments and associated additional features are also possible.

Figure 31:
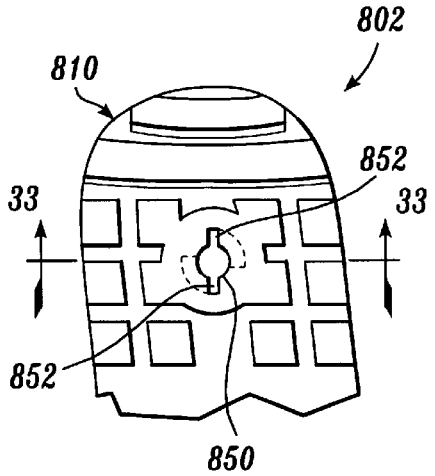
FIG. 31 is a partial bottom view of the sole of the boot illustrated in FIG. 26.

Referring now to FIGS. 31 through 35, the binding and boot binding interface will now be described. The construction of the binding interface at the toe end of boot 802 has been briefly described above. The interface at the heel end of boot 802 preferably includes a sole aperture 850, as illustrated in FIG. 31. Sole aperture 850 extends within sole 810 of boot 802 directly beneath the heel portion of boot 802. Sole aperture 850 projects vertically within sole 810 and includes lock slots 852 that also project vertically into sole 810. Lock slots 852 receive lock pin 874 and sole aperture 850 receives heel post 872, as described in more detail below in connection with FIG. 33.

Figure 32:
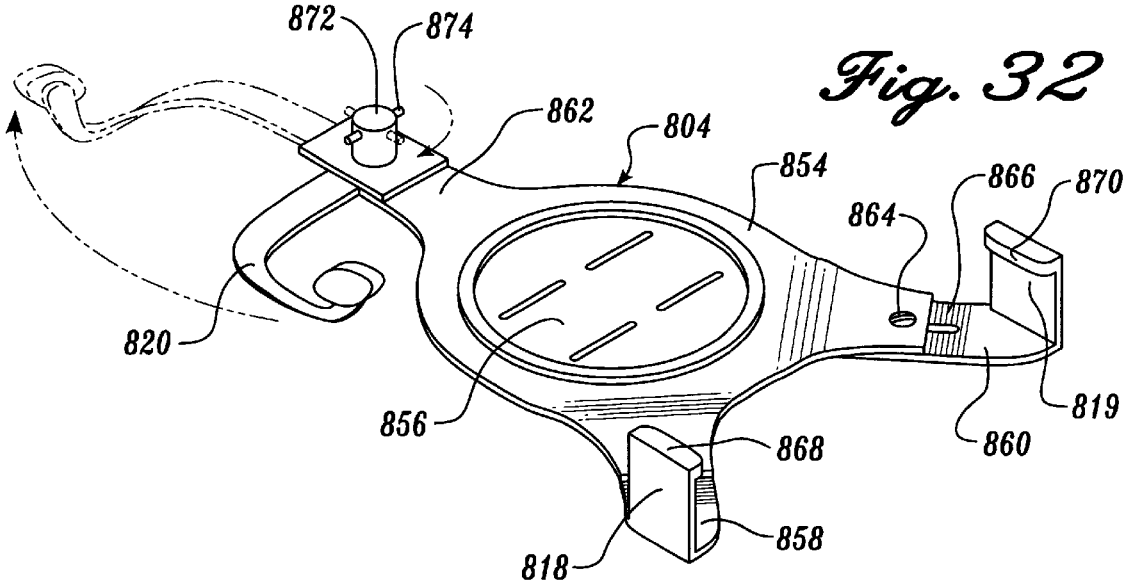
FIG. 32 is a perspective view of the binding illustrated in FIG. 26.

As shown in FIG. 32, binding 804 is constructed with a baseplate 854 secured to snowboard 806 with a rotor disc 856. Base plate 854 has a generally Y-shape configuration with a large hole in the center to receive disc 856. Disc 856 is similar to those used with conventional snowboard bindings including slots for fasteners to secure disc 856 to snowboard 806. Baseplate 854 may be rotated with respect to disc 856 for a snowboard rider to orient the boot position as desired. The Y-shape of baseplate 854 is created by lateral and medial arms 858 and 860 projecting forwardly of disc 856 and heel arm 862 projecting rearwardly. Lateral arm 858 and medial arm 860 are preferably adjustably secured to the remainder of baseplate 854 with fasteners 864. Fasteners 864 secure the forward ends of lateral and medial arms 858 and 860 to the remainder of baseplate 854 without securing arms 858 and 860 directly to snowboard 806. Locking serrations 866 are also provided on baseplate 854 and arms 858 and 860, such that, once fastener 864 is secured, additional retention is provided to prevent lateral and medial toe jaws 818 and 819 from pivoting with respect to baseplate 854 or from being inadvertently further extended with any slippage of fastener 864.

Lateral and medial toe jaws 818 and 819 project upwardly from the forwardmost ends of lateral and medial arms 858 and 860, respectively. Lateral and medial toe jaws 818 and 819 fall in generally parallel vertical planes and are preferably positioned to just clear the sides of the toe end of boot 802 to secure the toe end of boot 802 between them. The upper ends of lateral and medial toe jaws 818 and 819 include inwardly projecting ridges, medial ridge 868 and lateral ridge 870. Lateral and medial ridges 868 and 870 are positioned to engage within toe slots 816 to secure the forward end of boot 802. Ridges 868 and 870 preferably include a slight taper. They are wider at the forward ends such that their rearward ends may easily slide into toe slots 816 for engagement therewith.

The rearward end of binding 804 includes heel arm 862, lever 820, a heel post 872 and a lock pin 874. Heel arm 862 projects slightly upwardly at its rearward end in order to house lever 820 and allow lever 820 to pivot beneath heel arm 862 at the rearward end thereof Heel post 872 has a round cross section that projects upwardly from the end of lever 820. Heel post 872 is configured for engagement with sole aperture 850 within sole 810 of boot 802. Near the top of heel post 872, lock pin 874 projects outwardly on two sides. Preferably, lock pin 874 is a unitary pin that extends through a horizontal hole within the top of heel post 872.

Figure 33:
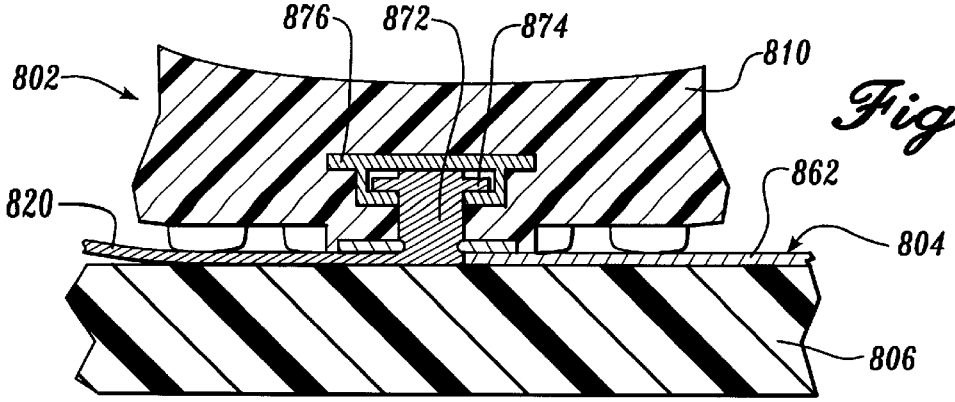
FIG. 33 is a partial cross-sectional view of the heel of the boot attached to the binding.

FIG. 33 illustrates the engagement of heel post 872 and lock pin 874 within sole aperture 850. Sole aperture 850 includes a heel mount 876. Heel mount 876 is preferably constructed of a rigid material such as metal to adequately engage and hold lock pin 874. When lever 820 is swung in a rearward direction, lock pin 874 extends along an axis generally parallel to the longitudinal axis of sole 810 such that it will slide within lock slots 852. Once heel post 872 is positioned within sole aperture 850, lever arm 820 can be rotated forwardly such that lock pin 874 moves out of alignment with lock slots 852 within the recess provided by heel mount 876. Heel mount 876 preferably includes a plate that extends generally horizontally within sole 810 to anchor heel mount 876 in place. Heel mount 876 also includes walls that project downwardly then inwardly toward the sides of heel post 872 to provide a shelf on which lock pin 874 may rest to secure sole 810 to binding 804. In this manner, sole 810 is secured from movement vertically, laterally, and longitudinally. Rotation of sole 810 about heel post 872 is prevented by lateral and medial toe jaws 818 and 819. Thus, a secure connection of boot 802 to snowboard 806 is effected with binding 804.

Figure 34:
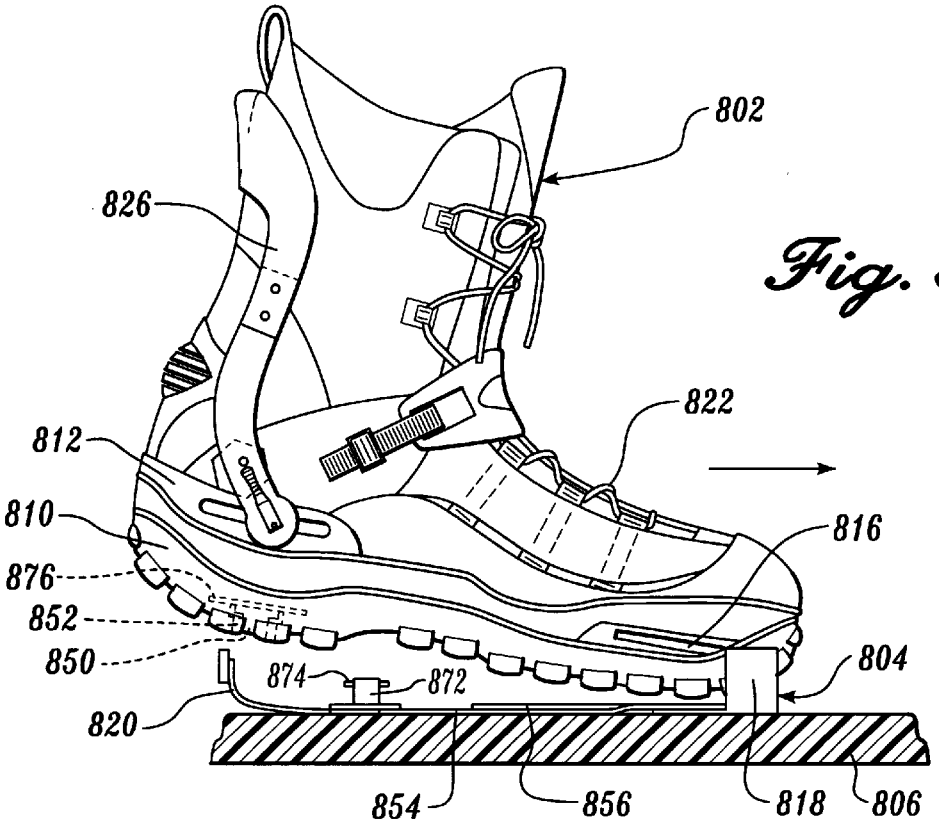
FIG. 34 illustrates entry of the toe of the boot between the binding ridges.
Figure 35:
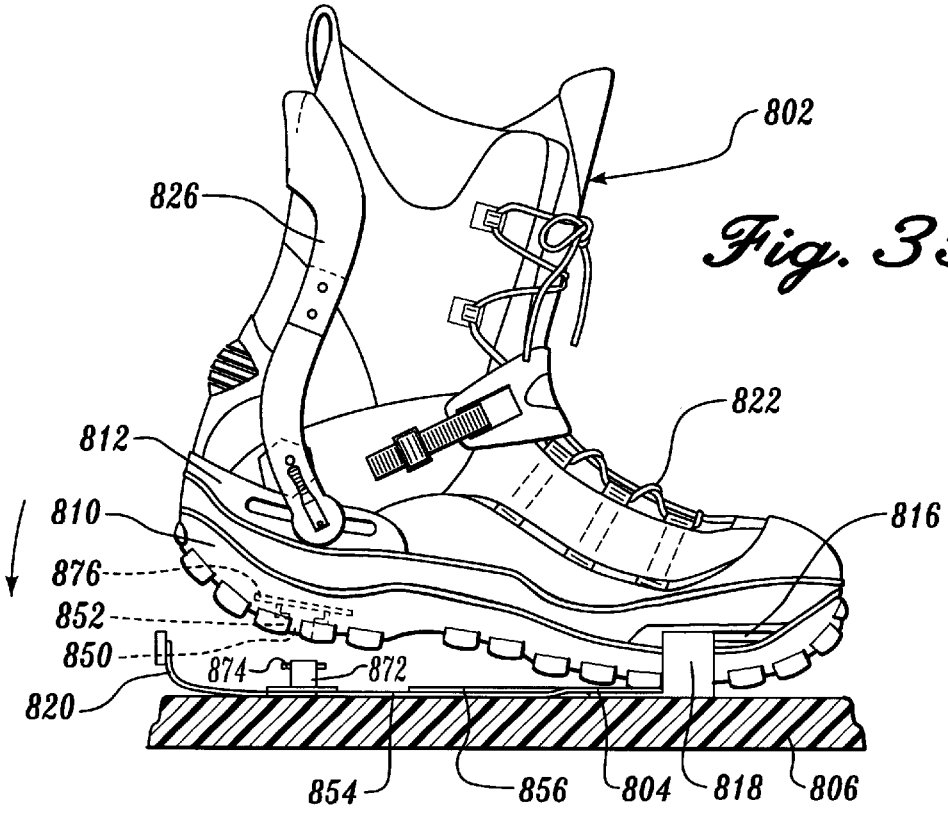
FIG. 35 is a side elevational view of the placement of the heel of the boot onto the binding.

FIGS. 34 and 35 further illustrate the ease of use of binding 804. As seen in FIG. 34, the toe portion of boot 802 is positioned adjacent lateral and medial toe jaws 818 and 819 such that toe slots 816 are aligned with ridges 868 and 870. Boot 802 is then shifted forwardly such that toe slots 816 slide around ridges 868 and 870 to thereby be engaged within slots 816. Forward sliding continues until ridges 868 and 870 reach the ends of toe slots 816. Once the ends are reached, the proper orientation of boot sole 810 is established for positioning over the top of heel post 872. As seen in FIG. 35, the heel of boot 802 may then be moved downwardly such that sole aperture 850 slides over the top of heel post 872. Lever 820 is then rotated in a counterclockwise direction forwardly to engage lock pin 874 within heel mount 876. The boot is thus secured to snowboard 806 without being releasable except by movement of lever 820 in a rearward direction.

The binding discussed above and illustrated in FIGS. 31 through 35, in combination with the boot interface of the toe slots and sole aperture, provides many advantages over prior art boot/binding systems. The sole of the boot can be flexible, since a rigid interconnection does not need to be maintained between slots 816 and sole aperture 850. This is because sole aperture 850 does not allow sole 810 to move either laterally or longitudinally. Therefore, the function of toe slots 816 and toe jaws 818 and 819 is confined to limiting vertical movement of the toe of boot 802 as well as resisting lateral movement of the toe of boot 802. A flexible sole increases the walking comfort of boot 802.

Toe slots 816 are also advantageous in their interconnection with toe jaws 818 and 819 since automatic alignment results. This allows for placement of sole aperture 850 over heel post 872, when ridges 868 and 870 abut the rearward ends of slots 816. A secure attachment is assured since lever 820 cannot be rotated forwardly unless lock pin 874 is properly within heel mount 876. Thus, there is no question whether or not the engagement is secure. By providing binding attachment at the ball of the foot and the heel of the foot, no toe or heel lift while edging a snowboard will result. Thus, increased control results.

All of the embodiments described above provide numerous advantages to snowboarders over snow boots and mountaineering-type boots. Edge control is achieved due to the support structure of the boot 20 including a highback or strut, base 24, and base strap 72 or 824, and other straps disclosed that may also be used. The boot also allows the convenience of a step-in binding. The straps do not have to be undone every time the board is taken off one foot or both, since the straps are on the boot itself. The arrangement of the step-in binding can also provide additional lateral flexibility, either in the binding itself or as tread 34 compresses and allows slight pivotal movement of the boot about the attachment to bindings 64 and 66.

Thus, edge control and step-in convenience are provided, while not sacrificing comfort and freestyle flexibility. The boot is easy to walk in and has more lateral flexibility for freestyle boarding than a mountaineering-type boot. Depending on which embodiment is used, the lateral flexibility of the boot is as great as with a conventional boot and a soft binding.

While the preferred embodiments of the invention have been illustrated and described, it will be appreciated that various changes can be made therein without departing from the spirit and scope of the invention. The embodiments shown and described are for illustrative purposes only and are not meant to limit the scope of the invention as defined by the claims.

The embodiments of the invention in which an exclusive property or privilege is claimed are defined as follows:

1. A snowboard boot having medial, lateral, forward, and rearward sides and being adapted for extending around the foot and lower portion of the leg of a wearer, the boot comprising:

(a) a sole having a heel portion and a toe portion;

(b) a non-rigid upper having non-rigid sides the upper being attached to said sole, said upper being flexible in fore, aft, lateral, and medial directions, said upper extending upwardly from said sole to surround the foot of the wearer and including a leg portion to surround an ankle of the wearer; and (c) a rigid strut attached to said sole, said strut extending adjacent the rearward side of said upper for restraining substantial aft movement of said leg portion while not substantially restricting fore and medial movement of said leg portion.

2. The snowboard boot of claim 1, wherein said leg portion of said upper is moveable relative to said strut.

3. The snowboard boot of claim 2, wherein said sole includes a rigid heel counter affixed thereto, said strut being secured to said heel counter.

4. The snowboard boot of claim 3, wherein said strut includes a strut release to substantially remove the aft restraint of said strut from said leg portion of said upper.

5. The snowboard boot of claim 4, wherein said strut further includes an adjustment means for changing the position of said strut relative to said sole, adjustment of said strut changing the angle at which the strut leans in the fore and aft directions.

6. The snowboard of claim 4, wherein said strut includes an upper portion and two side portions, a medial side portion attached to the medial side of said heel counter and a lateral side portion attached to the lateral side of said heel counter, said upper portion being pivotally and slidably connected to said side portions of said strut for rearward pivotal movement of said upper portion with respect to said side portions to remove aft support from said leg portion of said upper.

7. The snowboard boot of claim 3, wherein said strut is asymmetric, said strut including a lateral side, a medial side, and an upper portion, said upper portion of said lateral side of said strut curving forwardly more than said upper portion of said medial side to allow more freedom of movement of said leg portion of said upper of the boot in the medial direction.

8. The snowboard boot of claim 7, wherein said strut is pivotally secured to said heel counter for pivotal movement of said strut about a substantially vertical axis.

9. The snowboard boot of claim 8, wherein said lateral and medial sides of said strut are secured within lateral and medial slots, respectively, in said heel counter.

10. The snowboard boot of claim 9, wherein said lateral and medial side of said strut are secured to said heel counter slots with quick release fasteners.

11. The snowboard boot of claim 2, wherein said strut includes a strut release to substantially remove the aft restraint of said strut from said leg portion of said upper.

12. The snowboard boot of claim 1, wherein said strut includes a strut release to substantially remove the aft restraint of said strut from said leg portion of said upper.

13. The snowboard boot of claim 12, wherein said leg portion of said upper is moveable relative to said strut.

14. The snowboard boot of claim 13, wherein said sole includes a rigid heel counter affixed thereto, said strut being secured to said heel counter.

15. The snowboard boot of claim 14, wherein said strut further includes an adjustment means for changing the position of said strut relative to said sole, adjustment of said strut changing the angle at which the strut leans in the fore and aft directions.

16. The snowboard of claim 15, wherein said strut includes an upper portion and two side portions, a medial side portion attached to the medial side of said heel counter and a lateral side portion attached to the lateral side of said heel counter, said upper portion being pivotally and slidably connected to said side portions of said strut for rearward pivotal movement of said upper portion with respect to said side portions to remove aft support from said leg portion of said upper.

17. The snowboard boot of claim 14, wherein said strut is pivotally secured to said heel counter for pivotal movement of said strut about a substantially vertical axis.

18. The snowboard of claim 12, wherein said strut includes an upper portion and two side portions, a medial side portion attached to the medial side of said heel counter and a lateral side portion attached to the lateral side of said heel counter, said upper portion being pivotally and slidably connected to said side portions of said strut for rearward pivotal movement of said upper portion with respect to said side portions to remove aft support from said leg portion of said upper.

19. The snowboard boot of claim 1, wherein said strut is asymmetric, said strut including a lateral side, a medial side, and an upper portion, said upper portion of said lateral side of said strut curving forwardly more than said upper portion of said medial side to allow more freedom of movement of said leg portion of said upper of the boot in the medial direction.

20. The snowboard boot of claim 19, wherein said strut includes a strut release to substantially remove the aft restraint of said strut from said leg portion of said upper.

21. A snowboard boots having medial, lateral, forward, and rearward sides and being adapted for extending around the foot and lower portion of the leg of a wearer, the boot comprising:

(a) a sole having a heel portion and a toe portion;

(b) an upper attached to said sole, said upper being flexible in fore, aft, lateral, and medial directions, said upper extending upwardly from said sole and including a leg portion to surround a portion of the leg of the wearer; and (c) a rigid strut attached to said sole, said strut extending adjacent the rearward side of said upper for restraining substantial aft movement of said leg portion while not substantially restricting fore and medial movement of said leg portion, wherein said sole includes a rigid heel counter affixed thereto, said strut being secured to said heel counter, wherein said strut is asymmetric, said strut including a lateral side, a medial side, and an upper portion, wherein said leg portion of said upper is moveable relative to said strut, and said upper portion of said lateral side of said strut curving forwardly more than said upper portion of said medial side to allow more freedom of movement of said leg portion of said upper of the boot in the medial direction.

22. A snowboard boot having medial, lateral, forward, and rearward sides and being adapted for extending around the foot and lower portion of the leg of a wearer, the boot comprising:

(a) a sole having a heel portion and a toe portion;

(b) an upper attached to said sole, said upper being flexible in fore, aft, lateral, and medial directions, said upper extending upwardly from said sole and including a leg portion to surround a portion of the leg of the wearer, and (c) a rigid strut attached to said sole, said strut extending adjacent the rearward side of said upper for restraining substantial aft movement of said leg portion while not substantially restricting fore and medial movement of said leg portion, wherein said strut is asymmetric, said strut including a lateral side, a medial side, and an upper portion, said upper portion of said lateral side of said strut curving forwardly more than said upper portion of said medial side to allow more freedom of movement of said leg portion of said upper of the boot in the medial direction.

23. A snowboard boot having medial, lateral, forward, and rearward sides and being adapted for extending around the foot and lower portion of the leg of a wearer, the boot comprising:

(a) a semirigid sole having a heel portion and a toe portion;

(b) an upper attached to said sole, said upper being flexible in fore, aft, lateral, and medial directions, said upper extending upwardly from said sole and including a leg portion to surround a portion of the leg of the wearer; and (c) a rigid strut attached to said sole, said strut extending adjacent the rearward side of said upper for restraining substantial aft movement of said leg portion while not substantially restricting fore and medial movement of said leg portion.

* * * * *

UNITED STATES PATENT AND TRADEMARK OFFICE

CERTIFICATE OF CORRECTION

PATENT NO. : 5,906,058

DATED : May 25, 1999

INVENTOR(S) : C.J. Rench et al.

It is certified that error appears in the above-indentified patent and that said Letters Patent is hereby corrected as shown below:

| COLUMN | LINE | |
|---|---|---|
| Title page, item [63] | Related U.S. Appl. Data | "Pat. No. 5,802,744" should read -- Pat. No. 5,802,741-- |
| [56] | Refs. Cited (Foreign Patents) | Please insert the following reference: --0 634 115 A1 1/1995 European Pat. Off.-- |
| | Attorney, Agent, or Firm | "Kinness" should read --Kindness-- |
| 20 (Claim 1, | 47 line 6) | After "sides" insert --,-- |
| 22 (Claim 21, | 4 line 1) | "boots" should read --boot-- |
| 22 (Claim 22, | 37 line 10) | After "wearer" delete "," and insert therefor --;-- |

Signed and Sealed this

Twenty-third Day of November, 1999

*Attest:*

Q. TODD DICKINSON

*Attesting Officer*

*Acting Commissioner of Patents and Trademarks*